United States Patent [19]

Uemura et al.

[11] 4,352,594

[45] Oct. 5, 1982

[54] METHOD AND APPARATUS FOR CONSTRUCTING UNDERGROUND STRUCTURE

[76] Inventors: Koichi Uemura, No. 1-3-11, Sakura-machi, Koganei-shi, Tokyo; Makoto Uemura, No. 3-5-8, Hon-cho, Koganei-shi, Tokyo, both of Japan

[21] Appl. No.: 180,936

[22] Filed: Aug. 25, 1980

[51] Int. Cl.[3] ..... E21D 9/00; E21D 11/40

[52] U.S. Cl. ..... 405/138; 405/184; 405/141

[58] Field of Search ..... 405/132, 135, 136, 138, 405/137, 141–149, 184

[56] References Cited

U.S. PATENT DOCUMENTS

| | | | |
|---|---|---|---|
| 3,651,650 | 3/1972 | Weiss et al. | 405/184 |
| 3,708,984 | 1/1973 | Coleman | 405/138 |
| 3,733,835 | 5/1973 | Jacobs | 405/142 |
| 4,095,435 | 6/1978 | Uemura | 405/138 X |

*Primary Examiner*—Dennis L. Taylor

*Attorney, Agent, or Firm*—Toren, McGeady & Stanger

[57] ABSTRACT

A method and an apparatus for constructing an underground structure by having a plurality of serially adjoining cylindrical bodies propelled underground one after another either in one direction or from opposite directions. A thrusting/pulling jack advancing arrangement, thrusting jack and pulling jack advancing arrangements, connecting and traction members, fixing pieces and fasteners are used in combination to propel each cylindrical body one by one by virtue of a sum total of reaction forces developed at other cylindrical bodies and some additional reaction facility, if necessary.

42 Claims, 69 Drawing Figures

METHOD AND APPARATUS FOR CONSTRUCTING UNDERGROUND STRUCTURE

BACKGROUND OF THE INVENTION

1. Field of the Invention

This invention relates to a method and an apparatus for constructing an underground structure by propelling underground a plurality of preformed cylindrical bodies or by constructing an underground structure of a required shape in an underground area in the rear of preformed cylindrical bodies after they have been moved forward underground in a self-running manner.

2. Description of the Prior Art

The conventional methods and the apparatuses for advancing more than three cylindrical bodies underground have included many advancing jack arrangements of various types in the advancing facilities thereof. The number of locations at which such advancing jack arrangements must be provided increases according as the number of the cylindrical bodies to be moved forward increases. Hence, the mechanical facilities and the advancing operation of the conventional method and the apparatus are complex, extremely uneconomical and inefficient. Further, where a starting base is too short to have more than three cylindrical bodies constructed there, the advancing operation must be carried out with a necessary reaction force obtained from somewhere else. However, the conventional thrusting method in which the cylindrical bodies are to be propelled by thrusting jacks through struts with a reaction wall installed in the rear requires many huge struts. The thrusting method is thus inefficient and not only uneconomical but also tends to be hazardous because of jumping up or bending of the struts that likely takes place during the work there. The conventional pulling method requires many horizontal holes where it is impossible to obtain a necessary reaction force from the rear and is therefore also uneconomical.

Meanwhile, the conventional tunnelling method includes a shield driving method, Messel driving method, etc. However, in accordance with the conventional tunnelling method, boring and excavation work and assembling work on segments and timbering are to be performed in close vicinity to an excavation work area and thus cannot be performed independently of each other. Therefore, the boring and excavation work and the segment and timbering assembling work have to be alternately carried on. This requires a lengthy period of time for construction work. Besides, it is necessary to increase the strength of the segments and the timbering to make them strong enough against any horizontal axial force that is likely to be applied thereto. The conventional tunnelling method, therefore, is uneconomical because such an arrangement is required. In addition to that, this method often must be carried out at the risk of collapse of the excavated ground during the assembling work on the timbering.

SUMMARY OF THE INVENTION

It is a general object of the present invention to provide a novel method and an apparatus which are capable of eliminating the above stated drawbacks of the conventional known methods and in which an underground structure is constructed by propelling a plurality of serially adjoining preformed cylindrical bodies underground either in one direction or from opposite directions at necessary time intervals or by constructing an underground structure of a required shape in an underground area created in the rear of at least three preformed cylindrical bodies after they have been moved forward, in such a manner that the underground structure can be constructed not only with safety but also in a shorter period of time.

It is a more specific object of the invention to provide a method and an apparatus for constructing an underground structure wherein one set of thrusting/pulling jack advancing arrangement and one or two sets of thrusting jack advancing arrangement or one set of pulling jack advancing arrangement and two or three sets of thrusting jack advancing arrangement are arranged in various combinations with traction members, fixing pieces, connecting members and fasteners to have each of three or four or more than four cylindrical bodies advanced by pulling from the front of them with the pulling jack advancing arrangement. Thus, the three or four or more than four cylindrical bodies can be economically and efficiently advanced with these advancing arrangement by just adding the traction members and the fixing pieces as necessary. Further, where the starting base is too short for a self-running advancing operation, the traction members are arranged to penetrate horizontal holes or the like leading to an arrival base and then an underground structure can be constructed by having the cylindrical bodies advanced underground one after another with the pulling jack advancing arrangement, the thrusting jack advancing arrangement, the traction members, the fixing pieces, the connecting members and the fasteners used in combination and with a required reaction force obtained from a sum total of a reaction force available from a reaction facility provided at the arrival base and reaction forces available from other cylindrical bodies that are not moving forward. In this case, a reaction force available from a reaction wall provided in front of these cylindrical bodies is utilized to obtain an additional advancing force through the traction members. Therefore, unlike the conventional thrusting method, the use of huge struts is not necessary.

It is a further object of the invention to provide a method and an apparatus for constructing an underground structure in which two groups each consisting of more than two serially adjoining cylindrical bodies are advanced from two starting bases toward each other with the cylindrical bodies disposed at one starting base utilized as reaction facility for advancing the cylindrical bodies disposed at the other starting base. This arrangement obviates the necessity of having separate reaction facilities and is economical.

It is a still further object of the invention to provide a method and an apparatus for constructing an underground structure in which, after more than three serially adjoining preformed cylindrical bodies have been moved forward underground with self-running advancing facilities arranged on them, an underground structure of a desired shape is constructed by assembling segments, timbering, etc. within an underground space left in the rear of a rearmost cylindrical body. In this case, a ground excavating place is located away from the place where the segments, timbering, etc. are being assembled. Therefore, the construction work and excavating work can be carried on independently of each other with safety to permit reduction in the length of time required for the construction work. This is an economical method suitable for application to the construction of long tunnels in mountain and urban areas.

In the invented method as will be further defined in the appended claim 1, a plurality of serially adjoining cylindrical bodies are advanced undergound to construct an underground structure in the following manner: To bear a reaction force developed in advancing each of the cylindrical bodies one by one, either the sum of reaction forces of other cylindrical bodies or the sum of these reaction forces of other cylindrical bodies and the reaction force of a separately arranged reaction facility is used as reaction bearing force. Meanwhile, facilities for advancing the plurality of serially adjoining cylindrical bodies are formed by combining various advancing jack arrangements including a thrusting jack advancing arrangement, a pulling jack advancing arrangement, a thrusting/pulling jack advancing arrangement, etc. with traction members, fixing pieces which are arranged to be attachable to and detachable from the traction members, connecting members, fasteners which are provided with the connecting members and are attachable to and detachable therefrom, and reaction receiving members. These facilities are arranged in a suitable combination and are arranged in front of, in rear of, in between the cylindrical bodies and/or at a reaction facility as desired. Then, the plurality of the cylindrical bodies are moved forward one after another by operating these advancing arrangements as required. When, so required, an underground structure may be constructed in an underground space which is left behind the hindmost one of more than three cylindrical bodies after they have been moved forward in a self-running manner.

As will be clearly understood from the foregoing description, the reaction to the forward movement of each cylindrical body is obtained from the sum of the reaction forces available from other cylindrical bodies or from the sum of the reaction force of a reaction facility available in addition to those of other cylindrical bodies. Therefore, the invented method and the apparatus normally do not require the use of any separately arranged reaction facility in addition to the reaction forces available from other cylindrical bodies in advancing each cylindrical body and, even where the total reaction force available from other cylindrical bodies is insufficient, provision of only a small reaction facility would make up for such insufficiency. In case where an underground structure is to be constructed in the underground space left behind the hindmost of more than three cylindrical bodies after they have been advanced underground in the self-running manner, the ground excavating and boring work and the underground structure constructing work can be performed independently of each other as the locations of the two work areas are separated from each other. This not only permits reduction in the length of time required for the construction work but also ensures that the excavating and boring work on the front ground can be safely carried on as the workers are protected by the presence of the cylindrical bodies.

These and further objects, features and advantages of the invention will become apparent from the following detailed description of embodiments thereof, which will be further defined by the appended claims 2 to 25 taken in connection with the accompanying drawings.

BRIEF DESCRIPTION OF THE DRAWINGS

FIGS. 9*a*–9*d* and 9*a*1–9*a*3 are schematic views of Embodiment Example 9 showing the arrangement and a sequence of operation steps thereof.

DETAILED DESCRIPTION OF PREFERRED EMBODIMENTS

Example 1

Figure 1A:
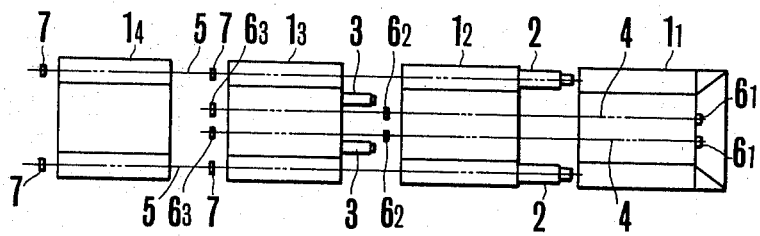
FIGS. 1*a*–1*e* are schematic views showing Example 1 of embodiment of the present invention, FIG. 1*a* showing the arrangement of the invented apparatus adapted for carrying out the invented cylindrical body advancing method and FIGS. 1*b*–1*e* respectively showing a sequence of steps of operation for carrying out the invented method.

FIGS. 1*a*–1*e* show an example of suitable arrangement of the various advancing facilities and operation thereof which will be defined in the appended claim 2 based on the method of the appended claim 1 for constructing an underground structure by advancing more than three serially adjoining preformed cylindrical bodies underground. In this example of embodiment, as shown in FIG. 1*a*, a pulling/thrusting jack advancing arrangement 2 is disposed between first and second cylindrical bodies $\mathbf{1}_1$ and $\mathbf{1}_2$ of more than three serially adjoining cylindrical bodies $\mathbf{1}_1$, $\mathbf{1}_2$, $\mathbf{1}_3$ and $\mathbf{1}_4$. A thrusting jack advancing arrangement 3 is disposed between the second and third cylindrical bodies $\mathbf{1}_2$ and $\mathbf{1}_3$. Traction members 5 are arranged to pierce through the pulling/- thrusting jack advancing arrangement 2 and the second and subsequent cylindrical bodies $1_2$, $1_3$ and $1_4$. Meanwhile, fixing pieces 7 which are arranged to releasably fix the traction members 5 are attached to the traction members 5 in front of the pulling/thrusting jack advancing arrangement 2 and in the rear of the third and fourth cylindrical bodies $1_3$ and $1_4$. Further, there are provided connecting members 4 which are arranged to pierce through the first, second and third cylindrical bodies $1_1$, $1_2$ and $1_3$ to have them connected to each other and are releasably connected to the front of the first cylindrical body $1_1$ and to the rears of the second and third cylindrical bodies $1_2$ and $1_3$ respectively by means of fasteners $6_1$, $6_2$ and $6_3$. In this manner, a mechanism is formed for advancing the serially adjoining four cylindrical bodies $1_1$, $1_2$, $1_3$ and $1_4$.

Figure 1B:
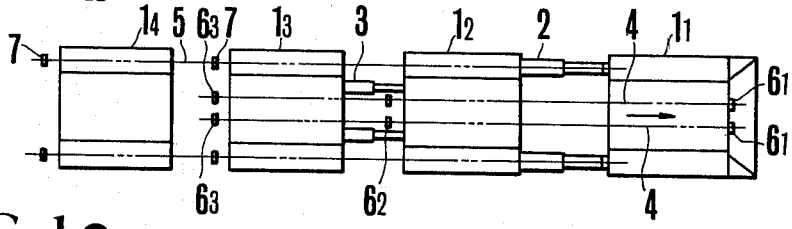

In the first step of operation which is shown in FIG. 1*b*, the first cylindrical body $1_1$ is moved forward in the following manner: The fasteners $6_2$ and $6_3$ of the connecting members 4 disposed in the rear of the second and third cylindrical bodies $1_2$ and $1_3$ are set free while the fixing pieces of the traction members 5 disposed in the rear of the third and fourth cylindrical bodies $1_3$ and $1_4$ are also set free. Then, the pulling/thrusting jack advancing arrangement 2 is operated to push forward the cylindrical body $1_1$ with a reaction force required for this obtained from the sum of the reaction forces of the second and third cylindrical bodies.

Figure 1C:
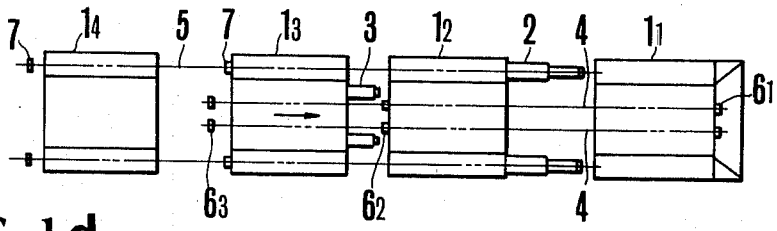
Figure 1D:
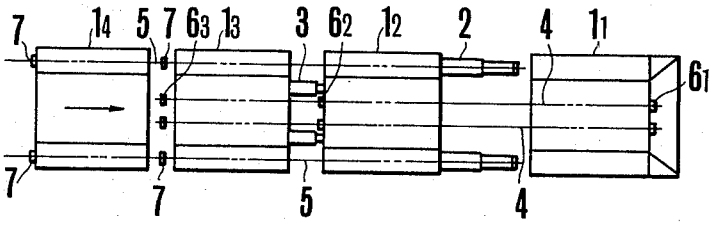

In the second step of operation which is shown in FIG. 1*c*, the fixing pieces 7 disposed in front of the pulling/thrusting jack advancing arrangement 2 and in the rear of the third cylindrical body $1_3$ are fixed to the traction members 5 while the fixing piece 7 disposed in the rear of the fourth cylindrical body $1_4$ is set free. The fasteners $6_1$ and $6_2$ disposed in front of the first cylindrical body $1_1$ and in the rear of the second cylindrical body $1_2$ are fixed to the connecting members to have the first and second cylindrical bodies thus connected to each other through the connecting members 4. Then, the pulling/thrusting jack advancing arrangement 2 is operated to have the third cylindrical body $1_3$ pulled forward with a reaction force required for this obtained from the sum of the reaction forces available from the first and second cylindrical bodies $1_1$ and $1_2$.

Following this, the fixing pieces 7 disposed in the rear of the third cylindrical body $1_3$ is set free. The fixing pieces 7 disposed in front of the pulling/thrusting jack advancing arrangement 2 and in the rear of the fourth cylindrical body $1_4$ are fixed to the traction members 5. The pulling/thrusting jack advancing arrangement 2 is then operated to have the fourth cylindrical body $1_4$ pulled forward through the traction member 5 with a reaction force required for this obtained from the sum of the reaction forces of the first and second cylindrical bodies $1_1$ and $1_2$ (see FIG. 1*d*).

Figure 1E:
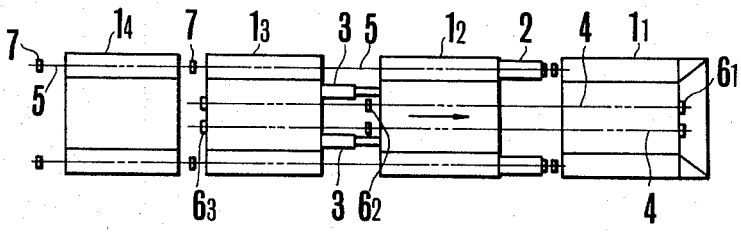

In the third step of operation which is shown in FIG. 1*e*, the fixing pieces 7 of the traction members 5 are set free. The fasteners $6_1$ and $6_3$ which are disposed in front of the first cylindrical body $1_1$ and in the rear of the third cylindrical body $1_3$ are fixed to the connecting members 4 to have the first and third cylindrical bodies connected to each other. Then, the thrusting jack advancing arrangement 3 which is disposed between the second and third cylindrical bodies $1_2$ and $1_3$ is operated to have the second cylindrical body $1_2$ thus pushed forward with a reaction force required for this obtained from the sum of the reaction forces of the first and third cylindrical bodies $1_1$ and $1_3$.

The three steps of operation described in the foregoing are repeated to have more than three serially adjoining cylindrical bodies advanced underground one by one for construction of an underground structure. In the meantime, the excavation, transport and disposal of earth and sand are carried out in accordance with the conventional method. The details of such work, therefore, is omitted from description here.

As will be clearly understood from the foregoing description, the reaction force required for moving the first, second and third cylindrical bodies forward one by one is obtained from the sum of the reaction forces of two of the three cylindrical bodies. The fourth and subsequent cylindrical bodies are moved forward with the required reaction force obtained from the sum of the reaction forces of the first and second cylindrical bodies or those of the first, second and third cylindrical bodies. In other words, in accordance with the advancing method of the present invention, all of the cylindrical bodies can be advanced one by one with the advancing facilities including only one set of the pulling/thrusting jack advancing arrangement and one set of the thrusting jack advancing arrangement. Unlike the conventional construction method, the advancing facilities of the invention do not require any additional advancing arrangements even when the number of the cylindrical bodies to be advanced increases. Further, it is not necessary to obtain the reaction force required for advancing the cylindrical bodies from earth, sand and the like but the required reaction force can be obtained from among the cylindrical bodies themselves in moving them forward in a continuous manner over an unlimited distance.

Since the cylindrical bodies are preformed, they can be used as a completed underground structure immediately after removal of the advancing facilities together with excavating and boring facilities. Thus, the invented method obviates the necessity of underground construction work such as cast-in-place concrete placing work and the like. Further, since the cylindrical bodies are thus prepared not in a place of poor workability such as within a pit but in a place of good workability under appropriate quality control, they can be prepared to have excellent strength for the construction of the underground structure.

EXAMPLE 2

In the second embodiment example of the invention which is shown in FIGS. 2*a*–2*e*, the method of Example 1 for constructing an underground structure by advancing more than three serially adjoining preformed cylindrical bodies underground as shown in FIG. 1 is modified in respect to arrangement of the various advancing facilities as will be further defined in the appended claim 3.

In Example 1, the pulling/thrusting jack advancing arrangement 2 is disposed between the first and second cylindrical bodies. However, in the case of Example 2, this pulling/thrusting jack advancing arrangement is replaced with a pulling jack advancing arrangement 8 which is specialized for pulling and a first thrusting jack advancing arrangement $3_1$ which is specialized for thrusting. Meanwhile, the thrusting jack advancing arrangement 3 which is disposed between the second and third cylindrical bodies $1_2$ and $1_3$ in Example 1 is replaced with a second thrusting jack advancing arrangement $3_2$ in this case. The rest of the advancing facilities for the serially adjoining four cylindrical bodies $1_1$, $1_2$, $1_3$ and $1_4$ are arranged in the same way as in Example 1. The arrangement for obtaining the required reaction forces is also identical with Example 1 and, therefore, is omitted from description here.

Figure 2A:
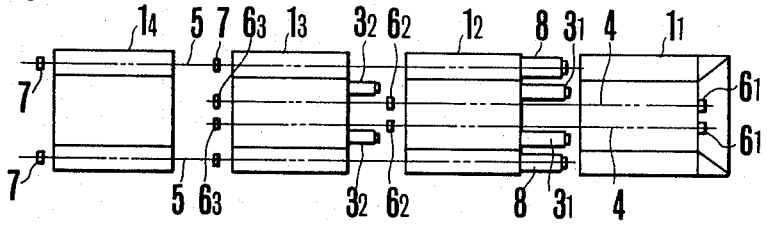
FIGS. 2*a*–2*e* are schematic views of Embodiment Example 2 showing the arrangement and steps of operation thereof.
Figure 2B:
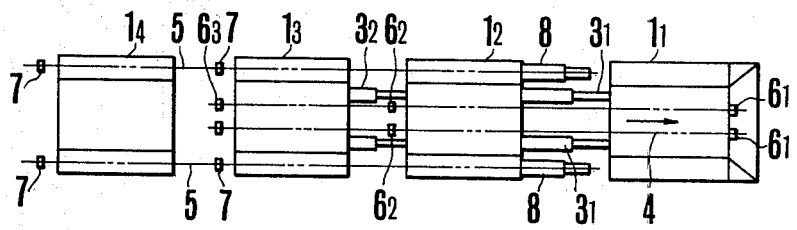
Figure 2C:
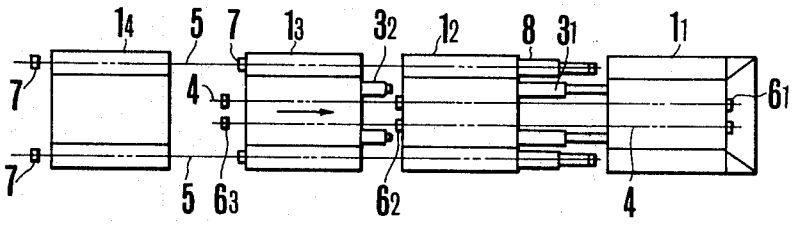
Figure 2D:
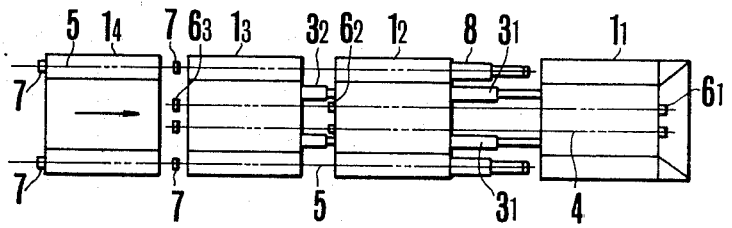
Figure 2E:
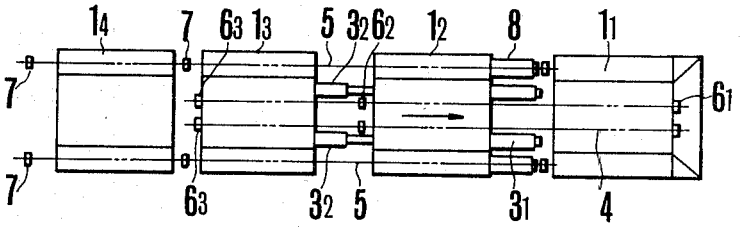

In the first step of operation which is shown in FIG. 2*b*, the first thrusting jack advancing arrangement $3_1$ is operated to push forward the first cylindrical body $1_1$ with a required reaction force for this obtained from the sum of the reaction forces of the second and third cylindrical bodies. In the second step of operation which is shown in FIGS. 2*c* and 2*d*, the pulling jack advancing arrangement 8 is operated to have the third and fourth cylindrical bodies moved forward one after another in the same way as in the second step of operation of Example 1. In the third step of operation which is shown in FIG. 2*e*, the second cylindrical body $1_2$ is moved forward by operating the second thrusting jack advancing arrangement in the same way as in the third step of operation of Example 1.

Then, the first, second and third steps of operation are suitably repeated to advance underground the serially adjoining four cylindrical bodies one by one for constructing an underground structure.

As will be clearly understood from the foregoing description, the first cylindrical body is pushed forward by the thrusting jack advancing arrangement while the third and subsequent cylindrical bodies are pulled forward one by one by operating the pulling jack advancing arrangement. This method of operation simplifies the structural arrangement of the fixing pieces and also simplifies the attaching and detaching operations on the fixing pieces to a great extent. Further, in case the first cylindrical body must be promptly moved forward when there happens a collapse of the earth and sand during excavating and boring work on the natural ground, the first thrusting jack advancing arrangement can be readily operated to promptly advance the first cylindrical body to prevent the collapse of the earth and sand. This is an advantage of this embodiment. Other advantages are identical with Example 1 and, therefore, are omitted from description here.

EXAMPLE 3

This is the third embodiment of the invention which is shown in FIGS. 3*a*–3*e* and will be further defined in the appended claim 4. The method of the embodiment example 3 is based on the method set forth in the appended claim 1 and is for constructing an underground structure by advancing more than three serially adjoining preformed cylindrical bodies underground with various advancing facilities arranged as described below:

The pulling jack advancing arrangement 8 and the fixing pieces 7 which are disposed between the first and second cylindrical bodies $1_1$ and $1_2$ in the preceding embodiment example are changed to be disposed in the front of the first cylindrical body $1_1$. Meanwhile, the traction members 5 are extended to pierce through the first cylindrical body $1_1$, the pulling jack advancing arrangement 8 and the fixing pieces to complete the arrangement of the advancing facilities for advancing the serially adjoining four cylindrical bodies $1_1$, $1_2$, $1_3$ and $1_4$. The first and second steps of operation which are shown in FIGS. 3*b* and 3*c* are performed to advance the first and second cylindrical bodies in the same way as in the first and third steps of operation of Example 2. In the third step of operation which is shown in FIGS. 3*d* and 3*e*, the pulling jack advancing arrangement 8 disposed in front of the first cylindrical body $1_1$ is operated to move forward the third and fourth cylindrical bodies $1_3$ and $1_4$ which are pulled forward one by one with a reaction force required for this obtained through the first thrusting jack advancing arrangement $3_1$ from the sum of the reaction forces of the first and second cylindrical bodies $1_1$ and $1_2$. For the third step of operation, the fixing pieces 7 are fixed to the traction members 5 in the rear of the cylindrical body to be pulled forward while other fixing pieces 7 that are disposed in rear of other cylindrical bodies are set free.

The first, second and third steps of operation are repeated as desired to move the serially adjoining cylindrical bodies forward underground for construction of an underground structure.

In addition to the advantages of Example 2, this embodiment example has another advantage in that, with the pulling jack advancing arrangement and the thrusting jack advancing arrangement disposed in separate locations from each other, their functions are specialized and simplified to enhance the operability thereof.

EXAMPLE 4

This is the fourth embodiment example of the invention which is shown in FIGS. 4*a*–4*e* and will be further defined in the appended claim 5. In this case, the method for constructing an underground structure by advancing more than three serially adjoining preformed cylindrical bodies underground as will be defined in the appended claim 1 is modified in respect to arrangement of the various advancing facilities as described below with reference to FIGS. 4*a*–4*e*.

Facilities for advancing the serially adjoining cylindrical bodies $1_1$, $1_2$, $1_3$ and $1_4$ are arranged in the same manner as in Example 3 with the exception of that the connecting members and the fasteners used in the advancing facilities of the Example 3 are not used in this case.

Figure 4A:
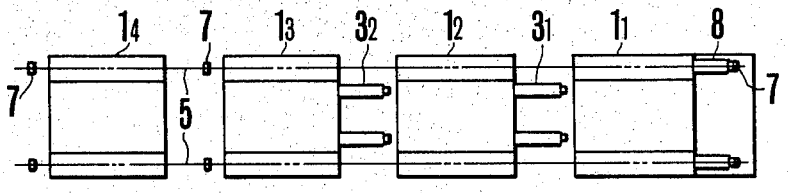
FIGS. 4*a*–4*e* are schematic views of Embodiment Example 4 of the invention showing the arrangement and the operation steps thereof.
Figure 4B:
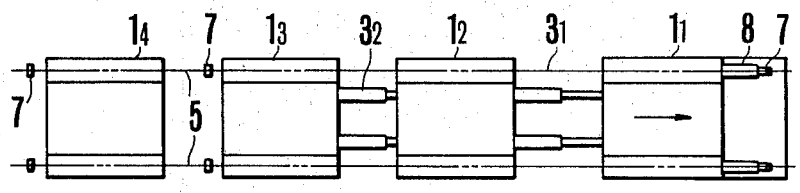
Figure 4C:
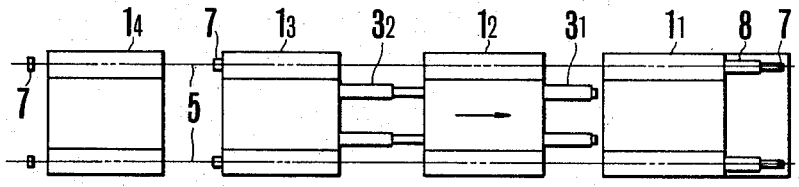
Figure 4D:
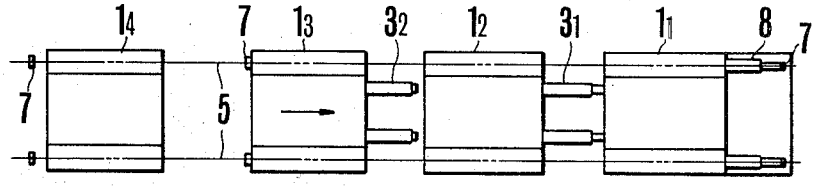
Figure 4E:
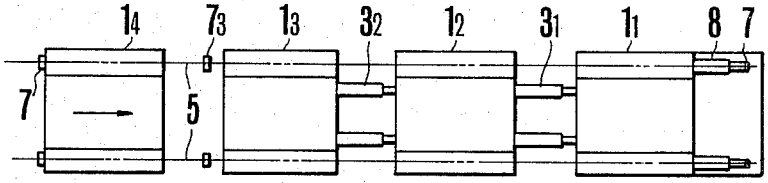

In advancing the first cylindrical body $1_1$ as shown in FIG. 4*b*, the first thrusting jack advancing arrangement is operated with a reaction force required for this obtained through the second thrusting jack advancing arrangement from the sum of the reaction forces of the second and third cylindrical bodies $1_2$ and $1_3$. To have the second cylindrical body advanced, as shown in FIG. 4*c*, the fixing pieces disposed in the rear of the fourth cylindrical body $1_4$ and in front of the pulling jack advancing arrangement 8 are fixed to the traction members 5 and then the second thrusting jack advancing arrangement $3_2$ is operated with a required reaction force obtained from the sum of the reaction forces of the first and third cylindrical bodies $1_1$ and $1_3$. The third and fourth cylindrical bodies $1_3$ and $1_4$ are advanced in the same manner as in the third step of operation of Example 3. These steps of operation are repeated to have the cylindrical bodies $1_1$, $1_2$, $1_3$ and $1_4$ moved forward one by one underground for construction of an underground structure.

As apparent from the foregoing description, the advancing facilities in this embodiment example do not include the connecting member and the fastener. This embodiment, therefore, is economical and simplifies the advancing operation. Other advantages of the embodiment are identical with those of Example 3 and, therefore, are omitted from description here.

Example 5

Figure 5A:
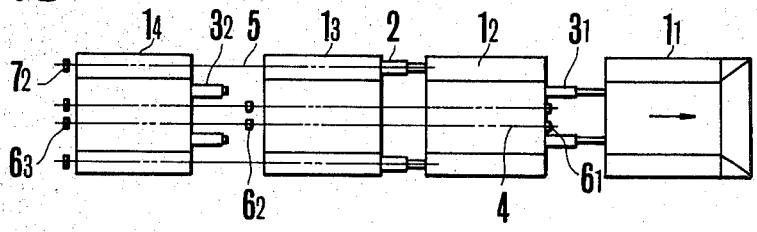
FIGS. 5*a*–5*d* are schematic views of Embodiment Example 5 showing the arrangement and the operation steps of the embodiment.

This is the fifth embodiment example of the invention which is shown in FIGS. 5*a*–5*d* and will be further defined in the appended claim 6. In this embodiment example, which is a method for constructing an underground structure by advancing more than four serially adjoining preformed cylindrical bodies underground and is based on the method defined in the appended claim 1, arrangement and operation of the various advancing facilities are as described below with reference to FIG. 5:

As shown in FIG. 5*a*, a first thrusting jack advancing arrangement $3_1$ is disposed between first and second cylindrical bodies $1_1$ and $1_2$. A second thrusting jack advancing arrangement $3_2$ is disposed between third and fourth cylindrical bodies $1_3$ and $1_4$. A pulling/thrusting jack advancing arrangement 2 is disposed between the second and third cylindrical bodies $1_2$ and $1_3$. Then, traction members 5 are arranged to pierce through and protrude from the pulling/thrusting jack advancing arrangement 2 and the third and fourth cylindrical bodies $1_3$ and $1_4$. In front of the pulling/thrusting jack advancing arrangement 2, fixing pieces $7_1$ are releasably attached to the traction member 5 while other fixing pieces $7_2$ are disposed in the rear of the fourth cylindrical body $1_4$. Further, connecting members 4 are arranged to pierce through the second, third and fourth cylindrical bodies $1_2$, $1_3$ and $1_4$. The connecting members 4 are provided with fasteners $6_1$, $6_2$ and $6_3$ which are attachably and detachably arranged connected to the connecting member 4 in front of the second cylindrical body $1_2$ and in rear of the third and fourth cylindrical bodies to complete the arrangement of advancing facilities to have the serially adjoining four cylindrical bodies moved forward.

In the first step of operation which is as shown in FIG. 5*a*, the first thrusting jack advancing arrangement $3_1$ is operated to move the first cylindrical body $1_1$ forward. A reaction force required for this step of operation is obtained from the sum of the reaction forces available from the two or three or more than three subsequent cylindrical bodies $1_2$, $1_3$, . . . through the pulling/thrusting jack advancing arrangement 2 and the second thrusting jack advancing arrangement $3_2$.

Figure 5B:
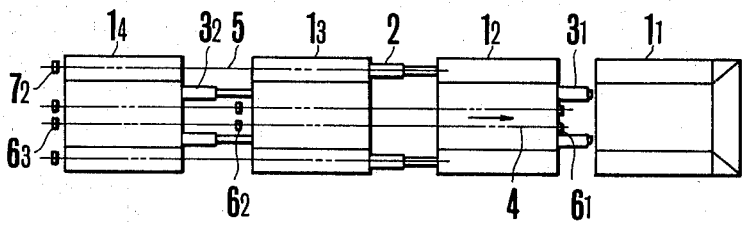

In the second step of operation which is as shown in FIG. 5*b*, the pulling/thrusting jack advancing arrangement 2 is operated to advance the second cylindrical body with a reaction force required for this obtained from the sum of the reaction forces of the third and fourth cylindrical bodies available through the second thrusting jack advancing arrangement $3_2$ disposed between the third and fourth cylindrical bodies $1_3$ and $1_4$. For this step of operation, the fixing pieces $7_2$ disposed in the rear of the fourth cylindrical body $1_4$ and the fasteners disposed in rear of the third and fourth cylindrical bodies are set free.

Figure 5C:
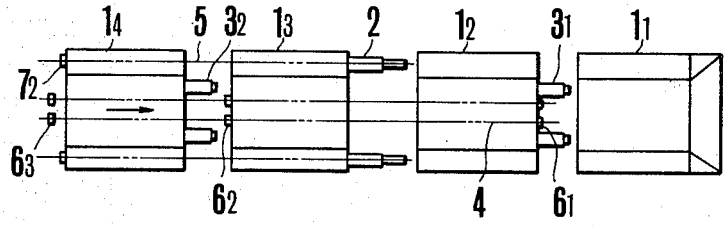
Figure 5D:
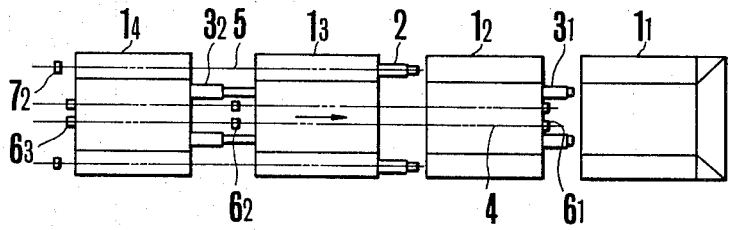

In the third step of operation which is as shown in FIG. 5*c*, the fixing pieces $7_1$ and $7_2$ are fixed to the traction members 5 while the fasteners $6_1$ and $6_2$ which are disposed in front of the second cylindrical body $1_2$ and in the rear of the third cylindrical body $1_3$ are fixed to the connecting members 4 to have the second and third cylindrical bodies connected to each other. Then, the pulling/thrusting jack advancing arrangement is operated to have the fourth cylindrical body pulled forward with a reaction force required for this obtained from the sum of the reaction forces of the second and third cylindrical bodies $1_2$ and $1_3$.

In the fourth step of operation, the fasteners $6_1$ and $6_3$ which are disposed in front of the second cylindrical body $1_2$ and in the rear of the fourth cylindrical body $1_4$ are fixed to the connecting members 4 and the second thrusting jack advancing arrangement $3_2$ is operated to move forward the third cylindrical body $1_3$ with a reaction force required for this obtained from the sum of the reaction forces of the second and fourth cylindrical bodies $1_2$ and $1_4$.

The four steps of operation are repeated as desired to have more than four serially adjoining preformed cylindrical bodies moved forward underground for construction of an underground structure as will be further described in the appended claim 1.

As will be clearly understood from the above description, the first cylindrical body is not used for obtaining a reaction force for advancing other cylindrical bodies. Therefore, the first cylindrical body is never retracted during the advancing operation performed on other cylindrical bodies, so that the natural ground to be excavated and bored can be kept safe without the fear of being loosened. Further, since the fourth cylindrical body and cylindrical bodies subsequent thereto are arranged to be advanced by operating the pulling/thrusting jack advancing arrangement to pull each of them forward, any increased number of cylindrical bodies can be processed with the same number of jack advancing arrangements. The method of this embodiment is therefore economical. Besides, since the cylindrical bodies are preformed before they are advanced underground, their strength can be ensured and they can be used as a part of a completed underground structure immediately after completion of the advancing operation.

EXAMPLE 6

Figure 6:
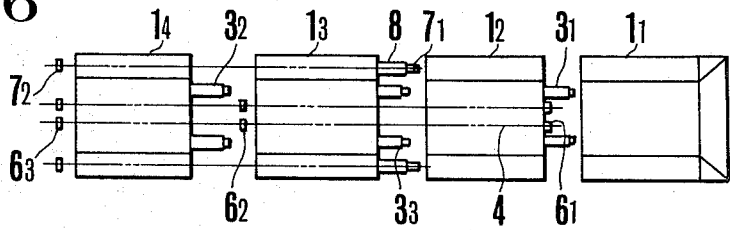
FIG. 6 is a schematic view of Embodiment Example 6 showing the arrangement thereof.

This is the sixth embodiment example of the invention which is shown in FIG. 6 and will be further defined in the appended claim 7. In this embodiment example, which is a method for constructing an underground structure by advancing more than four serially adjoining preformed cylindrical bodies underground and is based on the method defined in the appended claim 1, arrangement and operation of the various advancing facilities are as described below with reference to FIG. 6:

In this embodiment example, as shown in FIG. 6, the pulling/thrusting jack advancing arrangement 2 which is disposed between the second and third cylindrical bodies $1_2$ and $1_3$ in the case of the advancing facilities of Example 5 is replaced with a pulling jack advancing arrangement 8 which is specialized for pulling and a third thrusting jack advancing arrangement which is specialized for thrusting. With the exception of this, the advancing facilities of the embodiment example are identical with those of Example 5. The first step of operation to advance the first cylindrical body $1_1$ and the third step of operation to advance the third cylindrical body $1_3$ are carried out in the same manner as in the first and third steps of operation of Example 5. In the second step of operation to advance the second cylindrical body $1_2$, the third thrusting jack advancing arrangement $3_3$ is operated in place of the pulling/thrusting jack advancing arrangement 2 which is used in Example 5, and the second cylindrical body is moved forward in the same way as in the second step of operation of Example 5. In the fourth step of operation which is arranged to advance the fourth cylindrical body $1_4$, the above stated pulling jack advancing arrangement 8 is operated in place of the pulling/thrusting jack advancing arrangement 2 used in Example 5 and the fourth cylindrical body is thus pulled forward in the same way as in the fourth step of operation of Example 5. Cylindrical bodies $1_5$, $1_6$, . . . $1_n$ which are subsequent to the fourth cylindrical body $1_4$ are advanced in a manner similar to the fourth step of operation.

With these steps of operation repeated as desired, each of the cylindrical bodies are moved forward underground one by one for construction of an underground structure.

As apparent from the above description, in this embodiment example, the arrangement of the advancing facilities of Example 5 is changed by replacing the pulling/thrusting jack advancing arrangement with a pulling jack advancing arrangement which is arranged to serve the sole purpose of pulling and a thrusting jack advancing arrangement which is arranged to serve the sole purpose of thrusting the cylindrical body forward, so that the arrangement of the fixing pieces can be simplified and the advancing operation can be more easily performed. Other advantages of the embodiment example are the same as those of Example 5 and, therefore, are omitted from description here.

EXAMPLE 7

This embodiment example represents one of variations of the advancing facilities of the method for constructing an underground structure by advancing more than four serially adjoining preformed cylindrical bodies underground as will be defined in the appended claim 1. The method of this example which will be further defined in the appended claim 8 is as described below with reference to FIGS. *7a–7e:*

A pulling/thrusting jack advancing arrangement 2 is disposed between the first and second cylindrical bodies $1_1$ and $1_2$. First and second thrusting jack advancing arrangements $3_1$ and $3_2$ are respectively disposed between the second and third cylindrical bodies $1_2$ and $1_3$ and between the third and fourth cylindrical bodies $1_3$ and $1_4$. Traction members 5 are arranged to pierce through and to protrude from the pulling/thrusting jack advancing arrangement 2 and the second, third and fourth cylindrical bodies $1_2$, $1_3$ and $1_4$. Fixing pieces 7 which are arranged to releasably fix the traction members 5 are disposed in front of the pulling/thrusting jack advancing arrangement 2 and in the rear of the fourth cylindrical body $1_4$ to complete arrangement of the advancing facilities of the embodiment example for advancing the four serially adjoining cylindrical bodies $1_1$, $1_2$, $1_3$ and $1_4$.

In the first step of operation which is for advancing the first cylindrical body $1_1$ as shown in FIG. *7b,* the pulling/thrusting jack advancing arrangement 2 is operated to thrust the cylindrical body forward with a reaction force required for this obtained from the sum of the reaction forces of the second, third and fourth cylindrical bodies $1_2$, $1_3$ and $1_4$ which have the first and second thrusting jack advancing arrangement disposed among them.

In the second step of operation which is for advancing the second cylindrical body $1_2$ as shown in FIG. *7c,* the first thrusting jack advancing arrangement is operated to have the second cylindrical body thrusted forward with a reaction force required for this obtained from the sum of the reaction forces of the third and fourth cylindrical bodies which have the second thrusting jack advancing arrangement interposed in between them.

In the third step of operation which is for advancing the third cylindrical body $1_3$ as shown in FIG. *7d,* the fixing pieces 7 are fixed to the traction members 5 in a manner as shown in FIG. *7d.* Then, the second thrusting jack advancing arrangement is operated to have the third cylindrical body pushed forward with a reaction force required for this pushing operation obtained from the sum of the reaction forces of the second and fourth cylindrical bodies $1_2$ and $1_4$ which are available through the traction members 5.

In the fourth step of operation which is for advancing the fourth cylindrical body $1_4$ as shown in FIG. *7e,* the pulling/thrusting jack advancing arrangement 2 is operated to have the fourth cylindrical body which is connected thereto through the traction members 5 pulled forward with a reaction force required for this obtained from the sum of the reaction forces of the second and third cylindrical bodies which have the first thrusting jack advancing arrangement $3_1$ interposed in between them. Cylindrical bodies subsequent to the fourth cylindrical body $1_4$ are also moved forward in a manner similar to the fourth step of operation.

As will be clearly understood from the above description the arrangement of the embodiment example 7 does not necessitate any increase in jack advancing arrangements for processing any increased number of cylindrical bodies to be advanced. Such an increased number of the cylindrical bodies still can be advanced with the use of one set of the pulling/thrusting jack advancing arrangement together with two sets of the thrusting jack advancing arrangement. Further, since the first cylindrical body is not used for obtaining a reaction force required for advancing other cylindrical bodies, the first cylindrical body will never be retracted to ensure that excavation and boring work on the natural ground can be performed with safety.

EXAMPLE 8

This embodiment relates to a method for advancing more than four cylindrical bodies and is based on the method for constructing an underground structure by advancing serially adjoining preformed cylindrical bodies underground as will be defined in the appended claim 1. In this example, which will be further defined in the appended claim 9, the advancing facilities are arranged as described below with reference to FIG. 8:

The pulling/thrusting jack advancing arrangement 2 which is disposed between the first and second cylindrical bodies $1_1$ and $1_2$ in Example 7 is replaced with a pulling jack advancing arrangement 8 and a third thrusting jack advancing arrangement $3_3$ which are respectively arranged to perform their specialized functions to pull and push between the first and second cylindrical bodies $1_1$ and $1_2$ in this example of embodiment. With the exception of this, other advancing facilities are arranged in the same manner as in Example 7 to have more than four serially adjoining preformed cylindrical bodies moved forward one by one.

In the first step of operation which is for advancing the first cylindrical body, the third thrusting jack advancing arrangement is operated to push the first cylindrical body $1_1$ forward. In the second and third steps of operation, the second and third cylindrical bodies $1_2$ and $1_3$ are moved forward in the same manner as in the second and third steps of Example 7. In the fourth step of operation which is for advancing the fourth cylindrical body $1_4$, the pulling jack advancing arrangement 8 is operated to have the fourth cylindrical body pulled forward. Cylindrical bodies $1_5$, $1_6$, $1_7$, . . . $1_n$ subsequent to the fourth cylindrical body $1_4$ are also pulled forward in the same manner as in the fourth step.

The manner in which the reaction force required for advancing each cylindrical body at each step of operation is identical with the manner adopted in Example 7.

With these steps of operation repeated as desired, more than four serially adjoining cylindrical bodies $1_1$, $1_2$, $1_3$, $1_4$, . . . , $1_n$ are moved forward one by one for construction of an underground structure in accordance with the method which will be defined in the appended claim 1.

As apparent from the above description, since the first cylindrical body is arranged to be moved forward by operating the thrusting jack advancing arrangement which is specialized for pushing the first cylindrical body, in case where the natural ground being excavated and bored is in danger of collapse, the first cylindrical body can be immediately pushed forward to prevent it from collapsing. Other advantages of this embodiment example are identical with those of Example 7.

EXAMPLE 9

This is one of variations of arrangement of advancing facilities included in the method for constructing an underground structure by advancing more than two serially adjoining preformed cylindrical bodies underground as will be defined in the appended claim 1. The method of this example which will be further defined in the appended claim 10, is as described below with reference to FIGS. *9a–9d* and *9a1–9a3*:

As shown in FIG. *9a*, between a start base and an arrival base, there is provided a horizontal hole 9 to have them communicate with each other. On the side of the arrival base, there is installed a reaction facility 10. Traction members 5 are arranged to pierce through two cylindrical bodies $1_1$ and $1_2$ disposed on the start base, the horizontal hole 9 and the reaction facility 10. Each of the traction member 5 has a fixing piece 7, which is arranged to attachably and detachably fix the traction member 5, attached thereto at one end thereof either in front of the reaction facility 10 of in the rear of the second cylindrical body $1_2$ while a first pulling jack advancing arrangement $8_1$ which is provided with another fixing piece 7 is disposed at the other end of each traction member 5. Between the first and second cylindrical bodies $1_1$ and $1_2$, there is disposed a first thrusting jack advancing arrangement $3_1$. Meanwhile, connecting members 4 are arranged to pierce through and protrude from these cylindrical bodies. Each of the connecting members 4 has a fastener 6, which is arranged to attachably and detachably fix the connecting member 4, attached thereto at one end thereof either in front of the first cylindrical body $1_1$ or in the rear of the second cylindrical body $1_2$ while a second pulling jack advancing arrangement $8_2$ which is provided with another fastener 6 is disposed at the other end of each connecting member 4. The facilities for having the serially adjoining two cylindrical bodies moved forward are completed in this manner.

In the first step of operation which is for advancing the first cylindrical body $1_1$ as shown in FIG. *9b*, the fixing pieces 7 which are disposed in front of the reaction facility 10 and at the first pulling jack advancing arrangement $8_1$ are respectively fixed to the traction members 5. Then, with a reaction developed at the reaction facility 10 transmitted to the second cylindrical body $1_2$ through the traction member 5, the first thrusting jack advancing arrangement $3_1$ interposed in between the first and second cylindrical bodies $1_1$ and $1_2$ is operated to push forward the first cylindrical body $1_1$ with a reaction force required for this obtained from the sum of the reaction forces developed at the reaction facility 10 and the second cylindrical body $1_2$.

In the second step of operation which is for advancing the second or the hindmost cylindrical body $1_2$ as shown in FIG. *9c*, the fasteners 6 disposed in front of the first cylindrical body $1_1$ and in the rear of the second pulling jack advancing arrangement $8_2$ are fixed to the connecting members 4, both the first and second pulling jack advancing arrangements $8_1$ and $8_2$ are operated to have the second cylindrical body $1_2$ pulled forward with a reaction force required for this obtained from the sum of a reaction force of the first cylindrical body $1_1$ which is available through the connecting members 4 and a reaction force of the reaction facility 10 which is available through the traction members 5 fixed there by the fixing pieces.

The preformed cylindrical bodies $1_1$ and $1_2$ are advanced underground by repeating the above stated first and second steps of operation for construction of an underground structure in accordance with the method as defined in the appended claim 1.

For advancing three cylindrical bodies instead of two, the second thrusting jack advancing arrangement is disposed between the second and third cylindrical bodies $1_2$ and $1_3$ as shown in FIG. *9d*. The connecting members 4 and the traction members 5 are extended to the rear of the third cylindrical body $1_3$. The first and second pulling jack advancing arrangements $8_1$ and $8_2$, the fixing pieces 7 and the fasteners 6 are moved to the rear of the third cylindrical body $1_3$. Then, the first and second cylindrical bodies $1_1$ and $1_2$ are moved forward by the first step of operation as described in the foregoing and the hindmost one $1_3$ is moved forward by the above mentioned second step of operation.

It is an advantage of the embodiment example 9 that two cylindrical bodies can be moved forward even when the start base is too short for accommodating three cylindrical bodies. Another advantage of this embodiment is that each cylindrical body can be advanced underground in the correct direction with a suitable guide provided on the base of the horizontal hole.

FIG. *9a1*, *9a2* and *9a3* show variations of the arrangement of Example 9. In each of these cases, the cylindrical bodies can be advanced in the same manner as the steps of operation of Example 9 described in the foregoing.

EXAMPLE 10

Figure 9A:
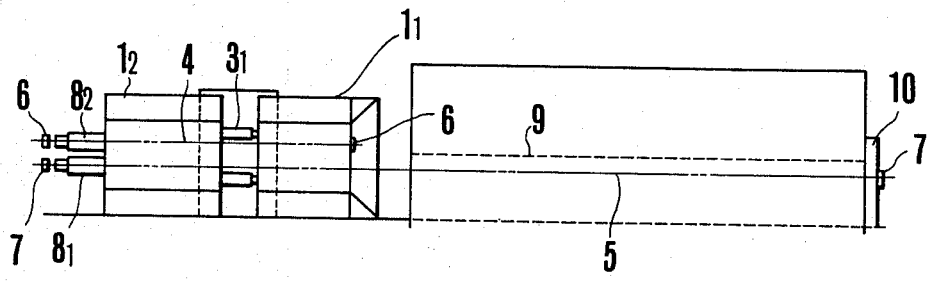
Figure 9B:
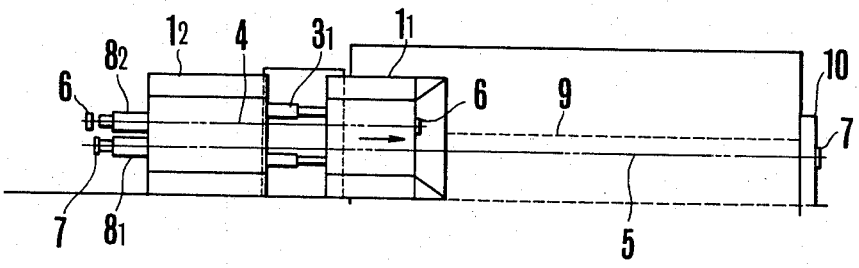
Figure 9C:
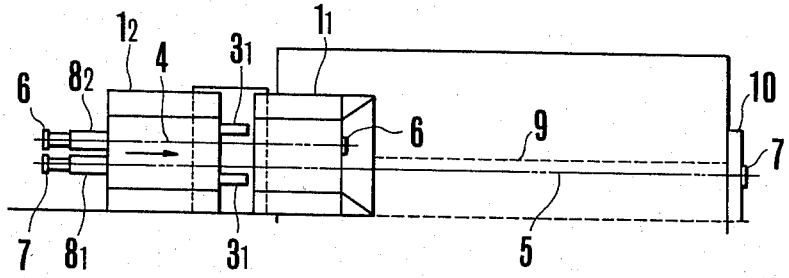
Figure 9D:
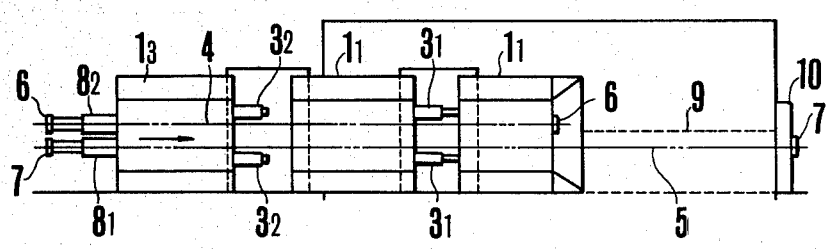
Figure 9D:
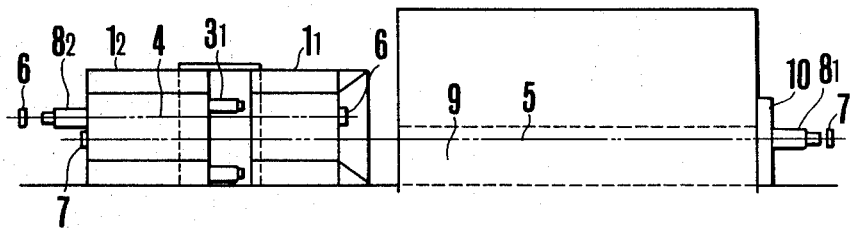
Figure 9D:
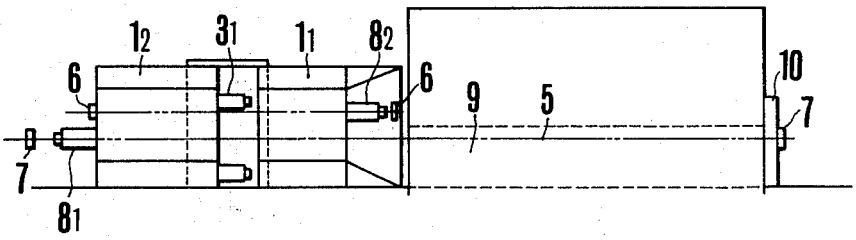
Figure 9D:
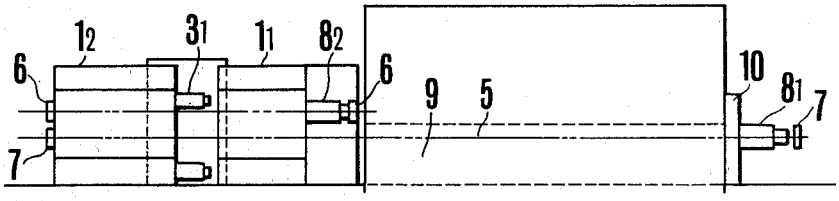

This is an embodiment example representing one of variations of arrangement of the advancing facilities included in the method for constructing an underground structure by advancing more than two serially adjoining preformed cylindrical bodies underground as will be defined in the appended claim 1. The method of this embodiment which will be further defined in the appended claim 11, is as described below with reference to FIGS. *10a–10d*:

In the arrangement of advancing facilities of this embodiment as shown in FIG. *10a*, fixing pieces 7 which is the same as the fixing piece 7 disposed in the rear of the hindmost cylindrical body $1_2$ in the case of FIG. 9*a*1 defined in the appended claim 10 are disposed not only at the hindmost cylindrical body $1_2$ but also attached to the traction members 5 in the rear of the other cylindrical body $1_1$. With the exception of this, the advancing facilities for advancing the two serially adjoining cylindrical bodies $1_1$ and $1_2$ are arranged in the same manner as in Example 9.

Figure 10A:
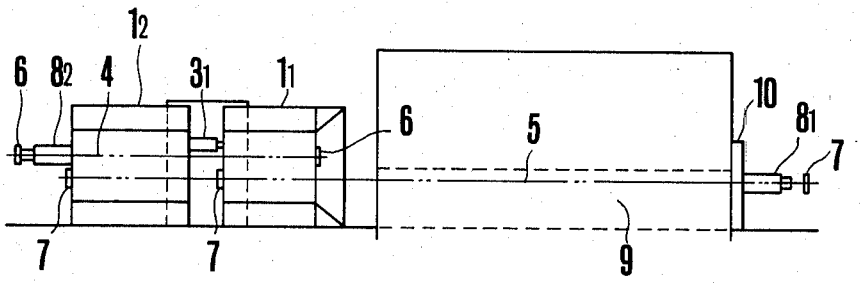
FIGS. 10*a*–10*d* are schematic views of Embodiment Example 10 showing the arrangement and a sequence of operation steps thereof.
Figure 10B:
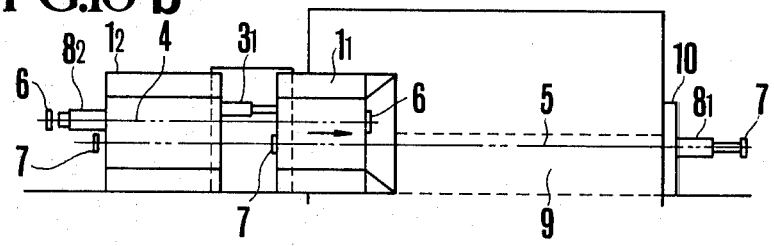

In the first step of operation which is to advance the first cylindrical body $1_1$ as shown in FIG. 10*b*, the fixing pieces 7 disposed in the rear of the first cylindrical body $1_1$ and in front of the first pulling jack advancing arrangement $8_1$ are fixed to the traction members 5 while other fixing pieces 7 are set free. Then, the first pulling jack advancing arrangement $8_1$ is operated to pull forward the first cylindrical body $1_1$ using a reaction force available from the reaction facility 10 through the traction members 5 and, concurrently with this, the first thrusting jack advancing arrangement $3_1$ is operated to push forward the first cylindrical body $1_1$ with the second cylindrical body $1_2$ used for obtaining a required reaction force for the pushing operation.

Figure 10C:
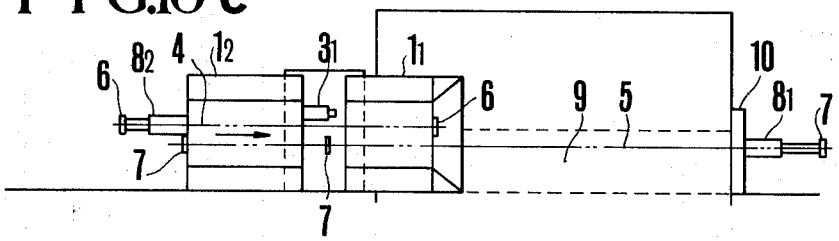

In the second step of operation which is for advancing the hindmost cylindrical body $1_2$ as shown in FIG. 10*c*, the fixing pieces 7 disposed in the rear of the second cylindrical body $1_2$ and in front of the first pulling jack advancing arrangement $8_1$ are fixed to the traction members 5 and then the first pulling jack advancing arrangement $8_1$ is operated. Concurrently with this, the fasteners 6 which are disposed in front of the first cylindrical body $1_1$ and in front of the second pulling jack advancing arrangement $8_2$ are fixed to the connecting members 4 and the second pulling jack advancing arrangement $8_2$ is operated to move the second cylindrical body $1_2$ forward with the first cylindrical body $1_1$ used for obtaining a required reaction force for this through the connecting members 4.

Figure 10D:
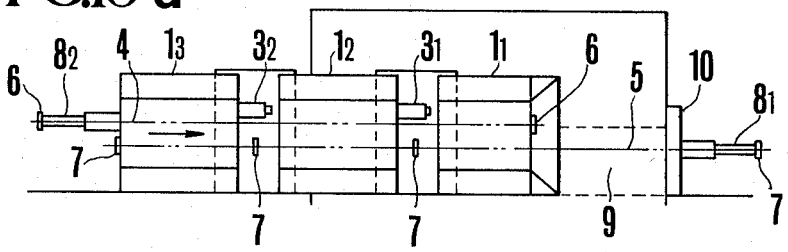

In case where the number of cylindrical bodies to be moved forward is three as shown in FIG. 10*d*, a second thrusting jack advancing arrangement $3_2$ is disposed between second and third cylindrical bodies. Traction members 5 and connecting members 4 are extended to have them protrude from the rear of the hindmost cylindrical body $1_3$. The second pulling jack advancing arrangement $8_2$, the fastener 6 and the fixing piece 7 are moved to the rear of the hindmost cylindrical body $1_3$. Then, the first and second cylindrical bodies $1_1$ and $1_2$ are moved forward one by one by the above stated first step of operation and the hindmost one $1_3$ by the above stated second step. The same procedures apply to four or more than four cylindrical bodies. With the above stated steps of operation repeated, more than two serially adjoining cylindrical bodies are advanced underground one by one for construction of an underground structure in accordance with the method which will be defined in the appended claim 1.

As apparent from the above description, since each of the cylindrical bodies is pulled forward by operating the first pulling jack advancing arrangement which is disposed on the arrival base, the advancing operation can be performed with a small thrusting jack advancing arrangement disposed between the cylindrical bodies. The method of the embodiment is, therefore, economical. Other advantages of the embodiment are the same as those described in Example 9 and, therefore, omitted from description here.

EXAMPLE 11

Figure 11:
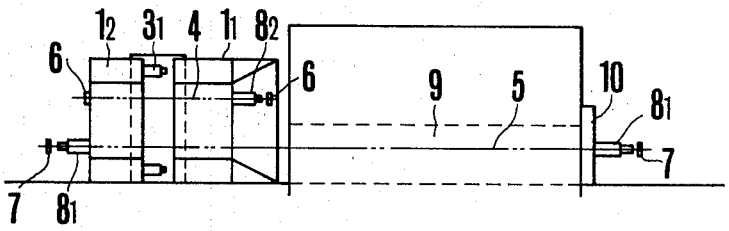
FIG. 11 is a schematic view of Embodiment Example 11 showing the arrangement thereof.

This is an embodiment example representing one of variations of arrangement of the advancing facilities included in the method for constructing an underground structure by advancing more than two serially adjoining preformed cylindrical bodies underground as will be defined in the appended claim 1. The method of this embodiment which will be further defined in the appended claim 12 is as described below with reference to FIG. 11:

As shown in FIG. 11, the fixing piece 7 which is disposed at one end of each traction member 5 in the methods of Examples 9 and 10 is replaced with a first pulling jack advancing arrangement $8_1$ which is provided with similar fixing pieces 7. With the exception of this, the facilities for advancing more than two serially adjoining preformed cylindrical bodies are arranged in the same manner as in Examples 9 and 10. In advancing each of the cylindrical bodies $1_1$, $1_2$, . . . $1_n$, the first pulling jack advancing arrangement $8_1$ which is disposed on one side is operated to have the elongation and/or slack of the traction members 5 absorbed there. After that, each cylindrical body is moved forward underground in the same manner as the operation steps of Examples 9 and 10 (or the methods defined in the appended claims 10 and 11).

It is an advantage of the embodiment that, in cases where the construction work must be performed over a long distance, slack produced by elongation of the traction member can be absorbed by the pulling jack advancing arrangement disposed on one side of the construction site while a pulling force or a reaction force can be transmitted by another pulling jack advancing arrangement disposed on the other side.

EXAMPLE 12

Figure 12A:
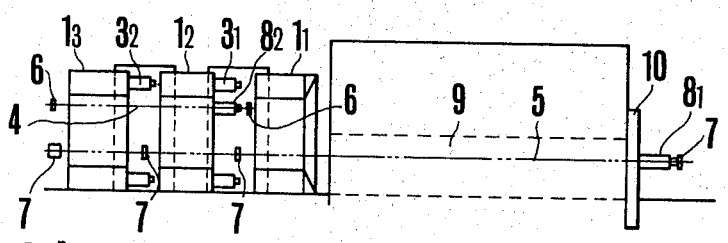
FIGS. 12*a*–12*e* are schematic views of Embodiment Example 12 showing the arrangement and operation steps thereof.

This embodiment example is also based on the method for constructing an underground structure by advancing serially adjoining preformed cylindrical bodies underground as will be defined in the appended claim 1. In this case, the arrangement of advancing facilities is for advancing more than three cylindrical bodies and is as described below with reference to FIGS. 12*a*–12*e* and will be further defined in the appended claim 13:

As shown in FIG. 12*a*, a horizontal hole 9 is arranged between a start base and an arrival base to have them communicate with each other. On the side of the arrival base, there is installed a reaction facility 10. Then, traction members 5 are arranged to pierce through and protrude from three cylindrical bodies $1_1$, $1_2$ and $1_3$ disposed on the side of the start base, the horizontal hole 9 and the reaction facility 10. In front of the reaction facility 10, there is disposed a first pulling jack advancing arrangement $8_1$ which is provided with a fixing pieces 7 arranged to be releasably fixed to the traction members 5 there. The traction members 5 are further provided with fixing pieces 7 which are disposed in the rear of each of the cylindrical bodies $1_1$, $1_2$ and $1_3$. Further, between the first and second cylindrical bodies $1_1$ and $1_2$, there is disposed a first thrusting jack advancing arrangement $3_1$. A second thrusting jack advancing arrangement $3_2$ is disposed between the second and third cylindrical bodies $1_2$ and $1_3$. The second cylindrical body and cylindrical bodies subsequent thereto $1_2$, $1_3$, . . . have connecting members 4 pierce through and protrude from them. In front of the second cylindrical body $1_2$, there is disposed a second pulling jack advancing arrangement $8_2$ equipped with fasteners 6 which are arranged to releasably fix the connecting members there. Further fasteners 6 are attached to the connecting members and are disposed in the rear of each of the third and subsequent cylindrical bodies $1_3$, . . . to complete arrangement of the advancing facilities for advancing more than three serially adjoining preformed cylindrical bodies.

Figure 12B:
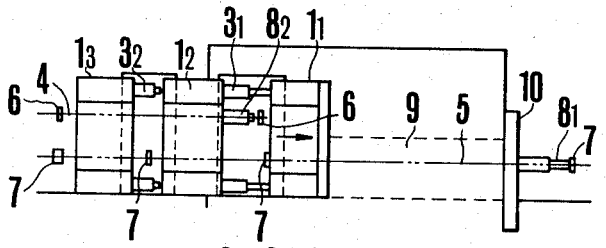

In the first step of operation which is for advancing the first cylindrical body $1_1$ as shown in FIG. 12*b*, the thrusting jack advancing arrangement $3_1$ which is interposed in between the first and second cylindrical bodies $1_1$ and $1_2$ is operated to have the first cylindrical body $1_1$ pushed forward with a reaction force required for this obtained from the second and third cylindrical bodies $1_2$ and $1_3$ through the second thrusting jack advancing arrangement $3_2$ which is interposed in between the second and third cylindrical bodies. Meanwhile, the fixing pieces 7 disposed in front of the first pulling jack advancing arrangement $8_1$ and in the rear of the first cylindrical body $1_1$ are fixed to the traction members 5 while the fixing pieces disposed in the rear of other cylindrical bodies $1_2$, $1_3$, . . . are set free. Then, concurrently with the operation of the thrusting jack advancing arrangement $3_1$, the first pulling jack advancing arrangement $8_1$ is operated to have the first cylindrical body $1_1$ pulled forward through the traction members 5 with a reaction force required for this obtained from the reaction facility 10.

Figure 12C:
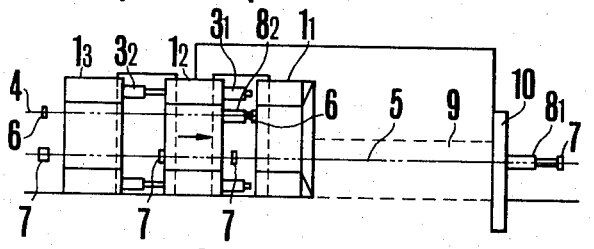

In the second step of operation which is for advancing the second cylindrical body $1_2$ as shown in FIG. 12*c*, the second thrusting jack advancing arrangement $3_2$ interposed in between the second and third cylindrical bodies $1_2$ and $1_3$ is operated to have the second cylindrical body $1_2$ pushed forward with a reaction force required for this pushing obtained from the third cylindrical body $1_3$. Meanwhile, the fixing pieces 7 disposed in front of the first pulling jack advancing arrangement $8_1$ and in the rear of the second cylindrical body $1_2$ is fixed to the traction members 5 while the fixing pieces 7 disposed in rear of other cylindrical bodies $1_1$ and $1_3$ are set free. Then, concurrently with the operation of the second thrusting jack advancing arrangement $3_2$, the first pulling jack advancing arrangement $8_1$ is operated to pull the second cylindrical body $1_2$ forward through the traction members 5. In both the first and second steps of operation, the fasteners 6 disposed in the rear of the third cylindrical body $1_3$ are set free.

Figure 12D:
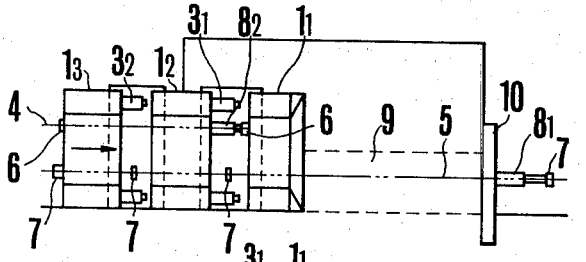

In the third step of operation which is for advancing the third cylindrical body $1_3$ as shown in FIG. 12*d*, the fixing pieces 7 of the traction members 5 and the fasteners 6 of the connecting members 4 are fixed in the rear of the third cylindrical body $1_3$ and the fixing pieces 7 disposed in rear of the first and second cylindrical bodies $1_1$ and $1_2$ are set free. Then, the second pulling jack advancing arrangement $8_2$ which has the second cylindrical body $1_2$ as a source of a reaction force is operated to pull the third cylindrical body $1_3$ through the connecting members 4. Then, concurrently with this, the first pulling jack advancing arrangement $8_1$ which has the reaction facility 10 as a reaction source is operated to pull forward the third cylindrical body $1_3$ through the traction members 5.

Figure 12E:
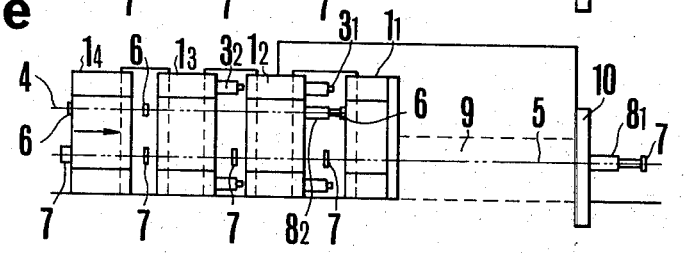

In case where four cylindrical bodies are to be advanced as shown in FIG. 12*e*, the connecting members 4 and the traction members 5 are extended to protrude from the rear of the fourth cylindrical body $1_4$ with additional fasteners 6 and additional fixing pieces 7 attached to the connecting members 4 and the traction members 5. Then, the first cylindrical body $1_1$ is advanced by the first step of operation. The second cylindrical body $1_2$ is advanced by the second step of operation and then the third and fourth cylindrical bodies $1_3$ and $1_4$ are respectively advanced by the third step of operation. The same procedures apply also to the advancing operation on five or more than five cylindrical bodies. With the above stated steps of operation repeated as desired, more than three serially adjoining cylindrical bodies $1_1$, $1_2$, $1_3$, . . . $1_n$ are advanced underground for construction of an underground structure in accordance with the method as will be defined in the appended claim 1.

As apparent from the above description, the third and subsequent cylindrical bodies are arranged to be moved forward without using any thrusting jack advancing arrangement but by jointly operating the first and second pulling jack advancing arrangement, so that any increased number of cylindrical bodies can be processed without use of any additional thrusting jack advancing arrangement. This embodiment thus permits reduction in the cost of thrusting jack advancing arrangements.

EXAMPLE 13

This is a thirteenth example of variation of the advancing facilities included in the method for constructing an underground structure by advancing more than three serially adjoining preformed cylindrical bodies underground as will be defined in the appended claim 1. The arrangement of this embodiment example is as described below with reference to FIGS. 13 and 13*a* and as will be further defined in the appended claim 14.

Figure 13:
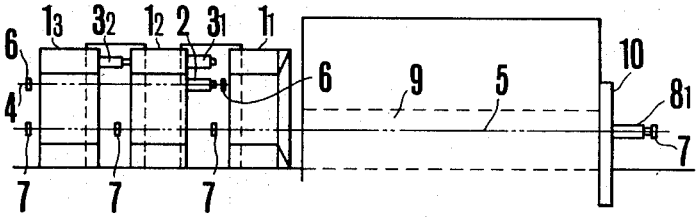
FIGS. 13 and 13*a* are schematic views of Embodiment Example 13 showing the arrangement and operation thereof.

As shown in FIG. 13, the second pulling jack advancing arrangement $8_2$, which is interposed in between the first and second cylindrical bodies $1_1$ and $1_2$ in Example 12 defined in the appended claim 13, is replaced by a pulling/thrusting jack advancing arrangement 2 in this embodiment example. With the exception of this, advancing facilities for advancing more than three serially adjoining cylindrical bodies $1_1$, $1_2$, $1_3$, . . . $1_n$ are arranged in the same manner as in the case of Example 12.

In the first step of operation which is for advancing the first cylindrical body $1_1$, the first pulling jack advancing arrangement $8_1$ is operated to pull the first cylindrical body $1_1$ through the traction members 5; and, at the same time, the thrusting jack advancing arrangement $3_1$ and the above stated pulling/thrusting jack advancing arrangement 2 are simultaneously operated to push forward the first cylindrical body $1_1$. In the second step of operation which is for advancing the second cylindrical body $1_2$, the second cylindrical body $1_2$ is moved forward in the same manner as the second step of operation of Example 12 (or the appended claim 13). In the third step of operation which is for advancing each of the third, fourth and subsequent cylindrical bodies $1_3$, $1_4$, . . . $1_n$, the use of the second pulling jack advancing arrangement $8_2$ which is adopted in the third step of Example 12 is replaced by the use of the pulling/thrusting jack advancing arrangement 2. With the exception of this charge, each of the cylindrical bodies $1_3$, $1_4$, . . . $1_n$ are moved forward in the same manner as in the third step of Example 12. The reaction forces required for the steps of the advancing operation are obtained in the same manner as in Example 12.

With the above stated steps of operation repeated, the serially adjoining cylindrical bodies $1_1$, $1_2$, $1_3$, . . . $1_n$ are advanced underground in accordance with the method as defined in the appended claim 1.

It is an advantage of this embodiment example that the first cylindrical body is arranged to have a pushing force applied thereto from the pulling/thrusting jack advancing arrangement, so that the use of the thrusting jack advancing arrangement between the first and second cylindrical bodies can be economized accordingly. This advantage is obtainable in addition to the same advantages as those of the appended claim 13 (or Example 12).

Figure 13A:
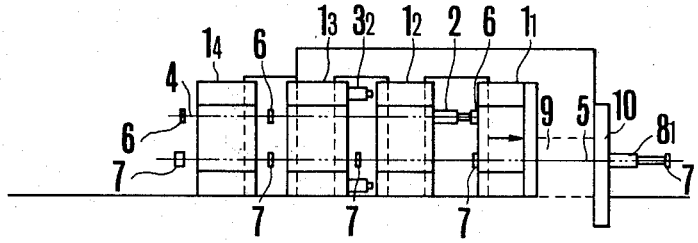

Further, FIG. 13*a* shows a modification of the above embodiment example. In this modification, the thrusting jack advancing arrangement $3_1$ which is shown in FIG. 13 is not used and the first cylindrical body $1_1$ is pushed forward by operating only the pulling/thrusting jack advancing arrangement 2.

EXAMPLE 14

This is a fourteenth embodiment example based on the method for constructing an underground structure by advancing more than three serially adjoining preformed cylindrical bodies underground as will be defined in the appended claim 1. In this embodiment example, the arrangement and operation for advancing more than three cylindrical bodies are as described below with reference to FIG. 14:

In this case, the fixing pieces 7 which are provided on the traction members 5 and are disposed in the rear of the hindmost cylindrical body $1_3$ or $1_4$ in Examples 12 and 13 (or claims 13 and 14) is replaced with a third pulling jack advancing arrangement $8_3$ which is provided with fixing pieces 7. Then, before carrying out the advancing operation on each of the cylindrical bodies $1_1$, $1_2$, $1_3$ and $1_4$, the third pulling jack advancing arrangement $8_3$ is operated to absorb the elongation and slack of the traction members 5. After that, each of the cylindrical bodies $1_1$, $1_2$, $1_3$ and $1_4$ is advanced underground by each of the operation steps of Examples 12 and 13 for construction of an underground structure in accordance with the method defined in the appended claim 1 and claims 13 and 14.

In addition to the advantages of Examples 12 and 13, this embodiment example has another advantage in that: In case the traction members are long, the advancing force can be effectively transmitted to each cylindrical body with the third pulling jack advancing arrangement operated to absorb the elongation and slack of the traction members 5 prior to the advancing operation.

EXAMPLE 15

This is a fifteenth example of embodiment based on the method for constructing an underground structure by advancing more than two serially adjoining preformed cylindrical bodies underground which will be defined in the appended claim 1. In this embodiment example, the arrangement and operation of cylindrical body advancing facilities are as described below with reference to FIGS. 15*a*–15*g*.

There is provided a horizontal hole 9 connecting two start bases which are suitably spaced (and which hereinafter will be called the first and second start bases). Two cylindrical bodies $1_1$ and $1_2$ are built on each of the first and second start bases. Then, traction members 5 are arranged to pierce through and protrude from the horizontal hole 9 and the cylindrical bodies $1_1$ and $1_2$ disposed on each start base. On the first start bases, a first thrusting jack advancing arrangment $3_1$ is disposed between the first and second cylindrical bodies $1_1$ and $1_2$ and is arranged to push the first cylindrical body $1_1$ there. On the second start base, there is disposed a first pulling jack advancing arrangement $8_1$ which is located in the rear of the hindmost cylindrical body $1_2$ and is provided with attachable and detachable fixing pieces 7 for the traction members 5. The traction members 5 are thus engaged with the fixing pieces 7 in the rear of the cylindrical body $1_2$. Meanwhile, intermediate members 11 which are made of wood or steel or some other suitable material are interposed in between the first and second cylindrical bodies $1_1$ and $1_2$ disposed on the second start base. The traction members 5 are further arranged to engage with other fixing pieces 7 which are disposed in the rear of each of the first and second cylindrical bodies $1_1$ and $1_2$ located on the first start base on the opposite side. The first and second cylindrical bodies $1_1$ and $1_2$ on this side are connected with each other by connecting members 4 which are provided with attachable and detachable fasteners 6. In the rear of the second cylindrical body $1_2$ which has the connecting members 4 protruding therefrom, there is disposed a second pulling jack advancing arrangement $8_2$. The second pulling jack advancing arrangement $8_2$ is provided with fasteners 6 which are arranged to engage the connecting members 4 protruding there. The arrangement of facilities for advancing the two cylindrical bodies disposed on each of the start bases is completed in this manner. In the first step of operation which is for advancing the first cylindrical body $1_1$ disposed on the first start base as shown in FIG. 15*b*, the fasteners 6 disposed in the rear of the second pulling jack advancing arrangement $8_2$ and the fixing pieces 7 disposed in the rear of the second cylindrical body $1_2$ for fixing the traction members 5 there are set free while the fixing pieces 7 disposed in the rear of the first cylindrical body $1_1$ and the fixing pieces 7 disposed in front of the first pulling jack advancing arrangement $8_1$ are fixed to the traction members 5. Then, the first pulling jack advancing arrangement $8_1$ is operated to pull forward the first cylindrical body $1_1$ with a reaction force required for this pulling operation obtained from the sum of reaction forces available from the first and second cylindrical bodies $1_1$ and $1_2$ disposed on the second start base through the intermediate members 11 interposed in between them. Meanwhile, concurrently with this pulling operation, the first thrusting jack advancing arrangement $3_1$ is operated to push the first cylindrical body $1_1$ forward with a reaction force required for the pushing operation obtained from the second cylindrical body $1_2$ disposed on the first base. In the second step of operation which is for advancing the second cylindrical body $1_2$ as shown in FIG. 15*c*, the fixing pieces 7 disposed at the first pulling jack advancing arrangment $8_1$ and the fasteners 6 disposed at the second pulling jack advancing arrangement $8_2$ are fixed respectively to the traction members 5 and the connecting members 4. Then, the second pulling jack advancing arrangement $8_2$ is operated to move forward the second cylindrical body $1_2$ with a reaction force required for this obtained from the first cylindrical body $1_1$ through the connecting members 4. Concurrently with this, the first pulling jack advancing arrangement $8_1$ is operated to have the second cylindrical body $1_2$ pulled forward to the extent of one stroke with a reaction force required for the pulling operation obtained from the sum of reaction forces developed at the first and second cylindrical bodies on the second start base through the intermediate members 11 interposed in between them. The first and second cylindrical bodies $1_1$ and $1_2$ disposed on the first start base are moved forward underground with excavation and boring underground up to a predetermined underground point. In moving forward the cylindrical bodies $1_1$ and $1_2$ disposed on the second start base as shown in FIG. 15*d*, the connecting members 4, the fasteners 6, the fixing pieces 7, the first thrusting jack advancing arrangement $3_1$ and the second pulling jack advancing arrangement $8_2$ are removed from the first start base and are installed on the second start base for the first and second cylindrical bodies $1_1$ and $1_2$ of the second start base in the same manner as they have been arranged on the first base. Meanwhile, the intermediate members 11 and the first pulling jack advancing arrangement $8_1$ which is disposed in the rear of the second cylindrical body $1_2$ are transferred to and installed in rear of the cylindrical bodies $1_1$ and $1_2$ of the first start base respectively. After completion of this interchanging transfer, the first and second cylindrical bodies $1_1$ and $1_2$ of the second start base are advanced respectively as shown in FIGS. 15*e* and 15*f* in the same manner as the cylindrical bodies $1_1$ and $1_2$ of the first start base. With these procedures performed or repeated as necessary, these cylindrical bodies of the two start bases are moved forward until they come to join with each other.

Figure 15A:
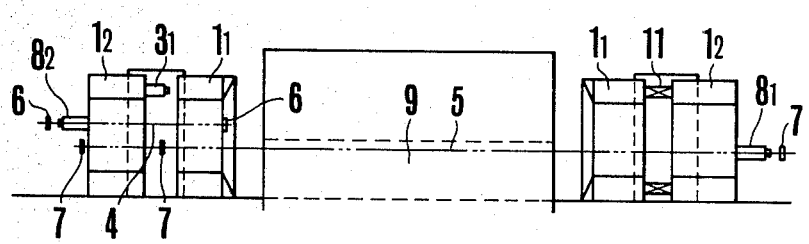
FIGS. 15*a*–15*g* are schematic views of Embodiment Example 15 showing the arrangement and operation steps thereof.
Figure 15B:
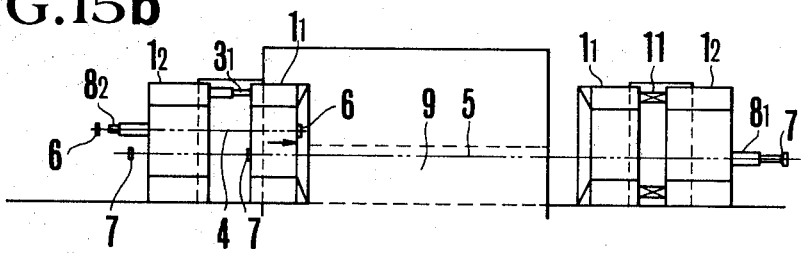
Figure 15C:
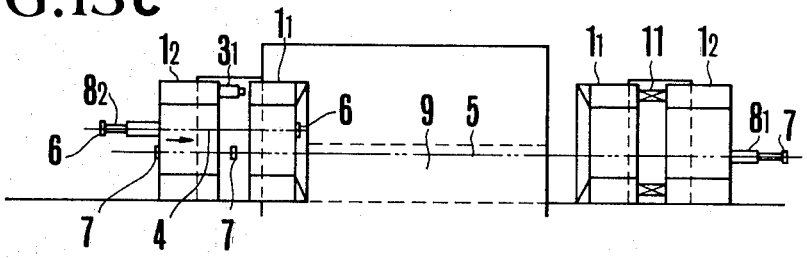
Figure 15D:
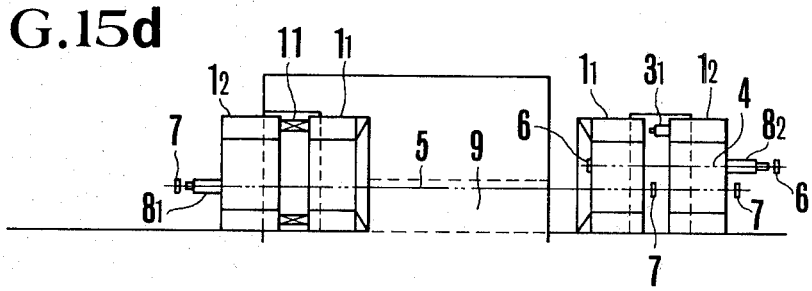
Figure 15E:
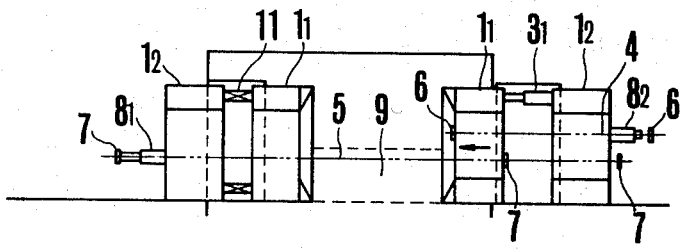
Figure 15F:
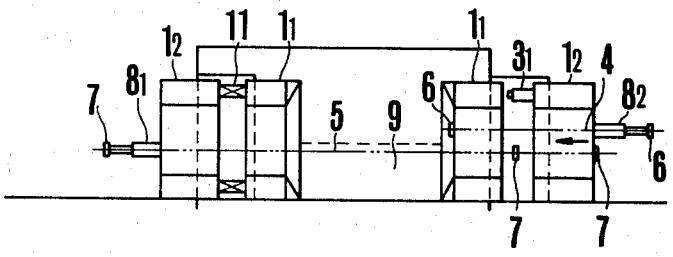
Figure 15G:
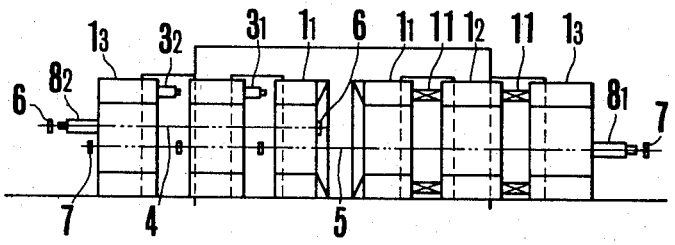

FIG. 15*g* shows an instance where each of the two start bases has three cylindrical bodies to advance. In this instance, the connecting members 4 on the first start base is extended to pierce through a third cylindrical body $1_3$. In the rear of the third cylindrical body $1_3$, there is disposed a second pulling jack advancing arrangement $8_2$ which is provided with fasteners 6 for engagement with the connecting members 4 while other fasteners 6 are disposed in front of the first cylindrical body $1_1$. The traction members 5 are also extended to pierce through and protrude from the third cylindrical body $1_3$ with fixing pieces 7 disposed in the rear of the third cylindrical body $1_3$. Between the second and third cylindrical bodies $1_2$ and $1_3$, there is installed a second thrusting jack advancing arrangement $3_2$. Meanwhile, on the second start base, the first pulling jack advancing arrangement $8_1$ is installed in the rear of a third cylinder $1_3$ with the traction members 5 engaged therewith. Additional intermediate members 11 are interposed in between the second and third cylindrical bodies $1_2$ and $1_3$ of the second start base. The three cylindrical bodies $1_1$, $1_2$ and $1_3$ of the first base are advanced in the same manner as the steps employed in advancing the two cylindrical bodies $1_1$ and $1_2$ as described in the foregoing. With the three cylindrical bodies of the first start base having been advanced underground one after another, the connecting members 4, fasteners 6 and the second pulling jack advancing arrangement $8_2$ which are disposed at these three cylindrical bodies of the first start base are transferred to the group of cylindrical bodies $1_1$, $1_2$ and $1_3$ of the second start base while the intermediate members 11 and the first pulling jack advancing arrangement $8_1$ disposed in the rear of the third cylindrical body $1_3$ are transferred to the three cylindrical bodies $1_1$, $1_2$ and $1_3$ of the first start base. With the facilities for advancing the three cylindrical bodies $1_1$, $1_2$ and $1_3$ of the second start base arranged in this manner, these cylindrical bodies are advanced underground with excavation and boring one by one in the order of the first one, the second one and the third one in the same manner as the steps of operation described in the foregoing until they come to join the other group. On each of the start bases, the third cylindrical body $1_3$ may be either built there in the beginning concurrently with the first and second ones or built after the first cylindrical body $1_1$ or the first and second cylindrical bodies $1_1$ and $1_2$ have been advanced underground by utilizing a space left behind them. In either case, the third cylindrical body is advanced in the same manner as described above.

In case where four cylindrical bodies are to be advanced from each of the two start bases, they can be also advanced underground in a manner similar to the steps of operation described in the foregoing for construction of an underground structure in accordance with the method as defined in the appended claim 1.

According to the conventional self-running advancing method, each start base must be long enough to accommodate at least three cylindrical bodies in general. However, as apparent from the above description, each start base does not have to have a space for more than two in accordance with the invented method. Besides, since the reaction force required in advancing one cylindrical body is available from more than three other cylindrical bodies, the invented method does not necessitate additional provision of a separate reaction facility. Further, in case where provision of a conducting hole is necessary for defining a correct cylindrical body advancing direction, the traction members serve this purpose without requiring any additional horizontal hole, so that the length of time required for the construction work can be shortened. It is another advantage in terms of reduction in the length of construction time that, while next cylindrical body is being built on one of the two start bases in a space left after two cylindrical bodies have been advanced underground, the cylindrical bodies disposed on the other start base can be advanced underground with excavation work, so that the length of construction time can be shortened by alternately repeating these processes. Besides, such alternate arrangement of processes also permits full labor utilization. In addition to these advantages, the two groups of cylindrical bodies can be advanced with only one set of advancing facilities. This arrangement thus contributes to reduction in the cost of machinery to a great extent.

EXAMPLE 16

This is a sixteenth example of embodiment based on the method for constructing an underground structure by advancing underground more than two serially adjoining preformed cylindrical bodies disposed on each of two start bases spaced at a given distance as will be defined in the appended claim 1. In this embodiment example, the arrangement and operation of cylindrical body advancing facilities are as described below with reference to FIG. 16 and as will be further defined in the appended claim 17:

In this case, the intermediate members 11 which are interposed in between the two cylindrical bodies $1_1$ and $1_2$ of the second start base in Example 15 (or the appended claim 16) is replaced with a thrusting jack advancing arrangement 3. With the exception of this change, other advancing facilities are arranged in the same manner as in Example 15. Each of the cylindrical bodies is arranged to be advanced in the same manner as in Example 15. At the time of the interchanging transfer of the advancing facilities, however, the above stated thrusting jack advancing arrangement is not transferred. The two groups of more than two cylindrical bodies disposed on two confronting start bases are thus advanced underground for construction of an underground structure in accordance with the method as defined in the appended claims 1 and 17. As will be apparent from the above description, with the intermediate members 11 replaced with the thrusting jack advancing arrangement, the thrusting jack advancing arrangement does not have to be transferred at the time of the interchanging transfer of advancing facilities between the two groups of cylindrical bodies, so that the length of construction time can be further shortened. Other advantages of this embodiment example are identical with those of Example 15 and, therefore, are omitted from description here.

EXAMPLE 17

This is a seventeenth example of embodiment based on the method set forth in the appended claim 1 for constructing an underground structure by advancing underground more than two serially adjoining preformed cylindrical bodies disposed on each of two start bases spaced at a given distance. In this embodiment example, arrangement and operation of cylindrical body advancing facilities are as described below with reference to FIG. 17 and as will be further defined in the appended claim 18:

In addition to the advancing facilities arranged in Example 16 (or the appended claim 17), the first and second cylindrical bodies $\mathbf{1}_1$ and $\mathbf{1}_2$ on the second start base are also provided with connecting members 4, fasteners 6 and a second pulling jack advancing arrangement $\mathbf{8}_2$. With the exception of this change, other advancing facilities are arranged in the same manner as in Example 16 or Example 15. Each of the cylindrical bodies $\mathbf{1}_1$ and $\mathbf{1}_2$ disposed on the first start base is advanced in the same manner as in Example 15. However, unlike the preceding examples 15 and 16, the connecting members 4, fasteners 6 and the second pulling jack advancing arrangement of the first start base are not transferred to the cylindrical bodies of the second start base before the start of the advancing operation on the cylindrical bodies $\mathbf{1}_1$ and $\mathbf{1}_2$ of the second start base. The group of more than two cylindrical bodies of each of the two start bases is thus advanced underground for construction of an underground structure in accordance with the method as defined in the appended claims 1, 16, 17 and 18.

As will be clearly understood from the above description, with the group of cylindrical bodies on the second start base also provided with the connecting members, fasteners and the second pulling jack advancing arrangment, this embodiment example obviates the necessity of interchanging transfer of these advancing facilities, so that the construction work can be more speedily performed. Since other advantages of the embodiment example are identical with those of Examples 15 and 16, they are omitted from description here.

EXAMPLE 18

This is an eighteenth example of embodiment based on the method set forth in the appended claim 1 for constructing an underground structure by advancing underground more than two serially adjoining preformed cylindrical bodies disposed on each of two start bases spaced at a given distance. In this embodiment example, the arrangement and operation of advancing facilities are as described below with reference to FIG. 18 and as will be further defined in the appended claim 19:

In this example, the fixing pieces 7 which are disposed in the rear of the hindmost cylindrical body $\mathbf{1}_2$ on the first start base in Examples 15, 16 and 17 are replaced with an additional first pulling jack advancing arrangement $\mathbf{8}_3$ which is provided with fixing pieces 7. With the exception of this change, other advancing facilities are arranged in the same manner as in Examples 15–17. The cylindrical bodiies disposed on the first start base are advanced in the same manner as in Examples 15–17. Then, the cylindrical bodies $\mathbf{1}_1$ and $\mathbf{1}_2$ of the second start base are advanced without transferring the first pulling jack advancing arrangement $\mathbf{8}_1$ before the advancing operation. Further, in case where the distance of the construction work is long, the elongation of the traction members 5 is absorbed by one of the first pulling jack advancing arrangements and then each of the cylindrical bodies are pulled forward with another set of the first pulling jack advancing arrangement. As apparent from the above description, in this embodiment example, no interchanging transfer of the first pulling jack advancing arrangement is required so that the construction work can be speeded up. Further, where the distance of construction work is long, the elongation of the traction members can be absorbed by one set of the first pulling jack advancing arrangement while another set of the first pulling jack advancing arrangement is operated to exert an advancing force on one of the cylindrical bodies. Other advantages of the embodiment example are identical with those of Examples 17 (or the appended claim 18) and, therefore, are omitted from description here.

EXAMPLE 19

Figure 19:
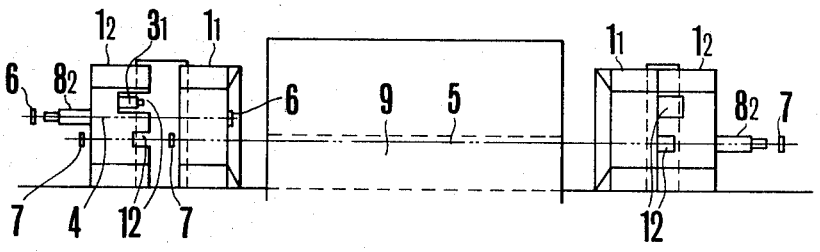

This is another example of embodiment based on the method set forth in the appended claim 1 for constructing an underground structure by advancing underground more than two serially adjoining preformed cylindrical bodies disposed on each of two start bases, which are spaced at a given distance. In this embodiment, the arrangement and operation of cylindrical body advancing facilities are as described below with reference to FIG. 19 and as will be further defined in the appended claim 20:

The advancing facilities are arranged in the same manner as in Examples 15–18 with the exception of that: The intermediate members 11 are not interposed in between the cylindrical bodies $\mathbf{1}_1$ and $\mathbf{1}_2$ of the second start base. Instead of them, there are provided cutaway parts 12 in the front part and the rear part of the cylindrical bodies $\mathbf{1}_1$ and $\mathbf{1}_2$ on both start bases as shown in FIG. 19 for the purpose of accommodating the thrusting jack advancing arrangement 3, the fixing pieces 7 and the fasteners 6. Then, each cylindrical body is advanced in the same manner as in Examples 15–18 (or the appended claims 16–19).

As will be understood from the above description, the arrangement to have the thrusting jack advancing arrangement 3 which is to be disposed between cylindrical bodies $\mathbf{1}_1$ and $\mathbf{1}_2$ placed within the above stated cutaway parts 12 formed by removing boxes or in some other suitable manner obviate the necessity of having the intermediate members 11 because, with this arrangement, the cylindrical bodies can be made to abut upon each other to serve as united source of a reaction force. This arrangement thus contributes to further reduction in the length of time required for construction. Other advantages of the embodiment example are similar to those of the preceding examples and, therefore, omitted from description here.

EXAMPLE 20

Figure 20A:
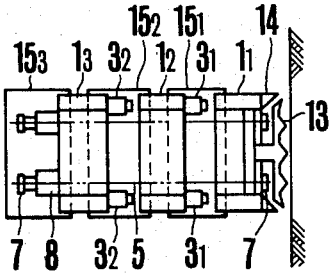
FIGS. 20*a*–20*d* are schematic views of Embodiment Example 20 showing the arrangement and operation steps thereof.
Figure 20B:
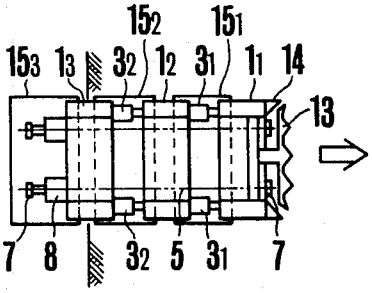
Figure 20C:
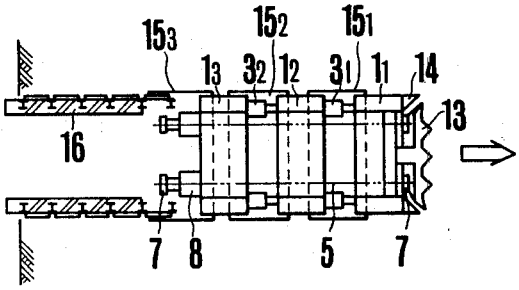
Figure 20D:
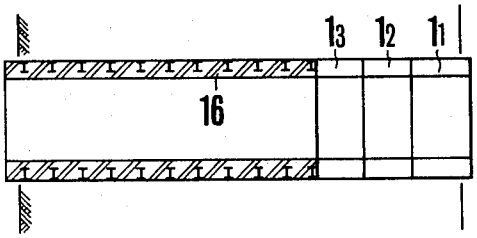

This is an example of embodiment based on the method set forth in the appended claims 1 to 9 for advancing more than three serially adjoining preformed cylindrical bodies for constructing an underground structure. In this example, a group of these cylindrical bodies are advanced underground in a self-running manner one after another and an underground structure of a desired shape is built within an underground space left in the rear of the hindmost cylindrical body. The arrangement and operation of advancing facilities of this embodiment example are as described below with reference to FIGS. 20*a*–20*d* and as will be further defined in the appended claim 21:

Thrusting jack advancing arrangements $3_1$ and $3_2$ are disposed between cylindrical bodies $1_1$ and $1_2$ and between cylindrical bodies $1_2$ and $1_3$ as shown in FIG. 20*a*. Traction members 5 are then arranged to pierce through and protrude from these cylindrical bodies $1_1$, $1_2$ and $1_3$. Each traction member 5 is provided with a fixing piece 7 disposed at the force end thereof while a pulling jack advancing arrangement 8 is disposed at the rear end of the traction member 5.

The front end of the first cylindrical body $1_1$ is provided with a cutting edge arrangement 14. In the hollow part at the fore end of the first cylindrical body $1_1$, there is provided an excavator 13. Further, protection cylinders $15_1$, $15_2$ and $15_3$ are installed in between the cylindrical bodies $1_1$ and $1_2$, between cylindrical bodies $1_2$ and $1_3$ and in the rear of the hindmost cylindrical body $1_3$. With the self-running advancing facilities arranged for the three cylindrical bodies $1_1$; $1_2$, and $1_3$ in the above stated manner, each of the cylindrical bodies is advanced by operating the advancing facilities with a reaction force required for moving it forward obtained from other two cylindrical bodies. In other words, in advancing the first cylindrical body $1_1$, the thrusting jack advancing arrangement $3_1$ is operated with a reaction force required for this obtained from the second and third cylindrical bodies $1_2$ and $1_3$. The second cylindrical body $1_2$ is advanced by operating the thrusting jack advancing arrangement $3_2$ with a reaction force required for this obtained from the first and third cylindrical bodies which are connected to each other by the traction members 5. Then, in advancing the third cylindrical body $1_3$, the pulling jack advancing arrangement 8 is operated to pull the third cylindrical body $1_3$ forward through the traction members 5 with a reaction force required for this obtained from the first and second cylindrical bodies $1_1$ and $1_2$. These steps of operation are repeated to have these cylindrical bodies advanced underground one after another. Following this, by utilizing the underground space which is being created to a suitable length behind the hindmost cylindrical body, an underground structure is gradually constructed there according as the cylindrical bodies are advanced.

In this embodiment example, as mentioned in the foregoing, the group of more than three cylindrical bodies are used as excavating and advancing facilities while the underground structure is constructed within the underground space created by excavation behind these cylindrical bodies. Since the site of construction work is thus separated from the site of the excavating work, the underground excavating work and the underground structure constructing work can be continuously carried on independently of each other. This arrangement not only contributes to reduction in length of time required for construction but, with the underground structure thus being built behind the group of cylindrical bodies, it is also free from the fear of being affected by an axial force (or a thrust) because they are advanced in a self-running manner without requiring a reaction force from the underground structure behind them. Therefore, the underground structure can be built there without taking into consideration any such axial force in the computation of its strength. Hence, this arrangement contributes to the reduction in the cost of the underground structure because it can be allowed to have only a sectional shape that is capable of withstanding just the pressure of the earth around it. This embodiment example ensures safety because the structure is free from the fear of being damaged. Further, since timberings and segments can be assembled within the protection cylinder behind the hindmost cylindrical body, the assembling work can be performed without the fear of falling stones, collapses, etc. Thus, the embodiment is not only economical but also teems with many advantages.

EXAMPLE 21

Figure 21A:
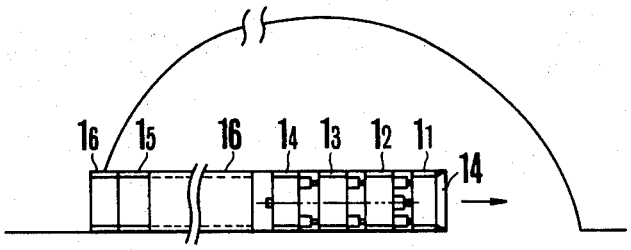
FIGS. 21*a* and 21*b* are schematic views of Embodiment Example 21 showing the arrangement and operation thereof.
Figure 21B:
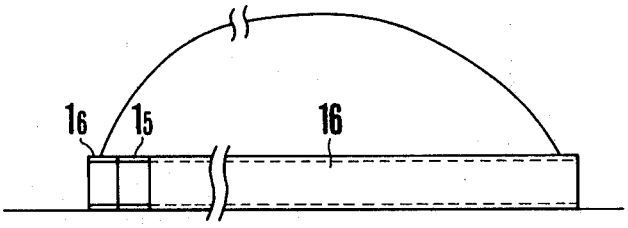

This embodiment example is based on the underground structure constructing method as defined in the appended claims 1 and 21. In this embodiment, the arrangement and operation of cylindrical body advancing facilities are as shown in FIGS. 21*a* and 21*b* and as will be defined in the appended claim 22. In this case, the number of preformed cylindrical bodies to be advanced underground which is more than three in Example 20 is changed to more than four. At least one counting from the hindmost of the serially adjoining cylindrical bodies is left underground near the entrance of an excavating hole and is used as a part of the underground structure while more than three other cylindrical bodies are further advanced underground. Then, by utilizing an underground space being gradually created in front of the left cylindrical body, an underground structure of a desired shape is constructed behind the advancing group of cylindrical bodies.

Referring to FIG. 21, six cylindrical bodies $1_1$, $1_2$, $1_3$, . . . $1_6$ are disposed on a start base. Then, thrusting jack advancing arrangements 3 are interposed in between the first and second cylindrical bodies $1_1$ and $1_2$, between the second and third bodies $1_2$ and $1_3$, and between the third and fourth bodies $1_3$ and $1_4$ respectively. A pulling jack advancing arrangement 8 is disposed in front of the second cylindrical body $1_2$ and is provided with fixing pieces 7 which are attachable to traction member 5. The traction members 5 are provided with further fixing pieces 7 which are disposed in the rear of each of the fourth, fifth and sixth cylindrical bodies $1_4$, $1_5$ and $1_6$. With self-running advancing facilities arranged in this manner, each of the cylindrical bodies is advanced in the same manner as in Example 8 (or as defined in the appended claim 9). When the last two cylindrical bodies $1_5$ and $1_6$ are moved to an underground point close to the entrance of the excavating hole, they are left there as shown in FIG. 21*b* while other cylindrical bodies $1_1$, $1_2$, $1_3$ and $1_4$ are allowed to be further advanced underground. Then, an underground structure 16 is gradually constructed in the underground space being created between the two rear cylindrical bodies and the advancing group of four cylindrical bodies.

Since the preformed cylindrical bodies are advanced and left at an underground point near the mouth of an excavating hole as described in the foregoing, this embodiment example obviates the necessity of performing difficult construction work at the entrance of a tunnel, so that the length of time required for construction can be shortened. Other advantages of the embodiment example are the same as those of Example 20.

EXAMPLE 22

Figure 22:
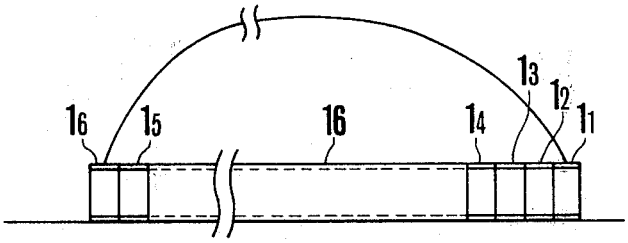
FIG. 22 is a schematic view of Embodiment Example 22 showing the arrangement thereof.

This example of embodiment is based on the underground structure constructing method as defined in the appended claims 1, 21 and 22. In this case, more than three preformed cylindrical bodies $1_1$, $1_2$, $1_3$ and $1_4$ are advanced underground in the same self-running manner as in Examples 20 and 21 (or claims 21 and 22) and, after completion of the advancing operation, these cylindrical bodies are used as a part of an underground structure with the advancing facilities removed therefrom as shown in FIG. 22 and as will be further defined in the appended claim 23.

The arrangement to leave the preformed cylindrical bodies for use as a part of the underground structure obviates the necessity of underground construction work such as primary and secondary coating work so that the cost of construction can be further lessened. Other details of the embodiment example are the same as those of Examples 20 and 21 and, therefore, are omitted from description here.

EXAMPLE 23

This example relates to an underground structure constructing apparatus adapted for carrying out the method of Example 1 as shown in FIG. 1*a* and as will be defined in the appended claim 24. Referring to FIG. 1*a*, the apparatus comprises in combination a pulling/-thrusting jack advancing arrangement 2 removably attached to the front of a second cylindrical body $1_2$ between first and second cylindrical bodies $1_1$ and $1_2$; a thrusting jack advancing arrangement 3 attached to the front of a third cylindrical body $1_3$ and is disposed between second and third cylindrical bodies $1_2$ and $1_3$; traction members 5 which are arranged to pierce through the above stated pulling/thrusting jack advancing arrangement 2, the second cylindrical body $1_2$ and other cylindrical bodies disposed subsequenty to the second one; attachable and detachable fixing pieces 7 which are attached to the traction members and are disposed at the head portion of the pulling/thrusting jack advancing arrangement 2 and between the third and subsequent cylindrical bodies $1_3$. . . ; connecting members 4 arranged to pierce through the first, second and third cylindrical bodies $1_1$, $1_2$ and $1_3$; and attachable and detachable fasteners $6_1$, $6_2$ and $6_3$ attached to the connecting members in front of the first cylindrical body $1_1$, between the second and third ones $1_2$ and $1_3$ and in the rear of the third one $1_3$.

EXAMPLE 24

This example of embodiment is an underground structure constructing apparatus adapted for carrying out the method of Example 2 as shown in FIG. 2*a* and as will be defined in the appended claim 25. Referring to FIG. 2*a*, the apparatus comprises in combination a pulling jack advancing arrangement 8 removably attached to the front of a second cylindrical body $1_2$ and disposed between first and second cylindrical bodies $1_1$ and $1_2$; thrusting jack advancing arrangements $3_1$ and $3_2$ which are disposed between the first and second cylindrical bodies $1_1$ and $1_2$ and between the second and third cylindrical bodies $1_2$ and $1_3$ and are removably attached either to the rear of the first cylindrical body $1_1$ or the front of the second cylindrical body $1_2$ and either to the rear of the second cylindrical body $1_2$ or to the front of the third cylindrical body $1_3$ respectively; traction members 5 arranged to pierce through the above stated pulling jack advancing arrangement 8, the second cylindrical body $1_2$ and all cylindrical bodies subsequent thereto; attachable and detachable fixing pieces 7 attached to the traction members 5 and are disposed at the head portion of the above stated pullling jack advancing arrangement 8 and between one and another among the cylindrical bodies including the third and subsequent cylindrical bodies; connecting members 4 arranged to pierce through each of the first, second and third cylindrical bodies $1_1$, $1_2$ and $1_3$; and attachable and detachable fasteners $6_1$, $6_2$ and $6_3$ attached to the connecting members 4 respectively in front of the first cylindrical body $1_1$, between the second and third ones $1_2$ and $1_3$ and in the rear of the third one $1_3$.

EXAMPLE 25

Figure 3A:
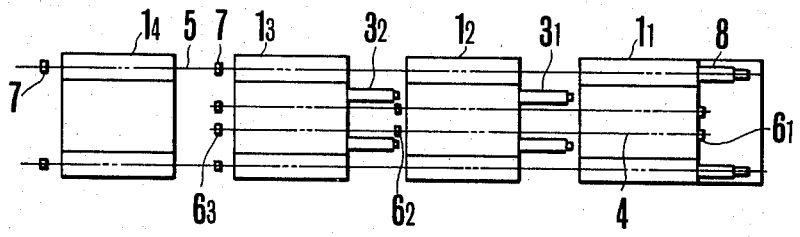
FIGS. 3*a*–3*e* are schematic views of Embodiment Example 3 of the invention showing the arrangement and the operation steps thereof.
Figure 3B:
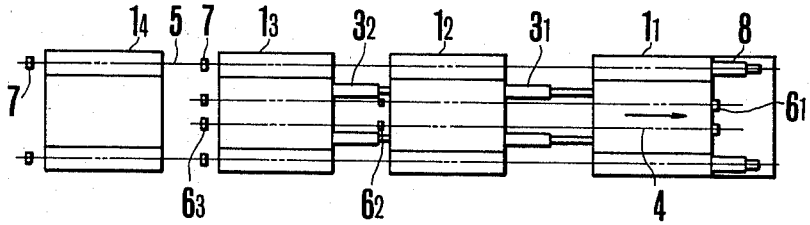
Figure 3C:
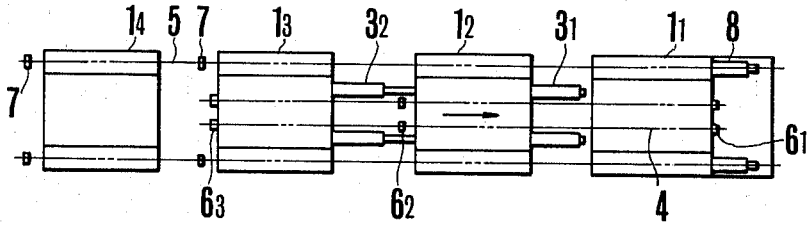
Figure 3D:
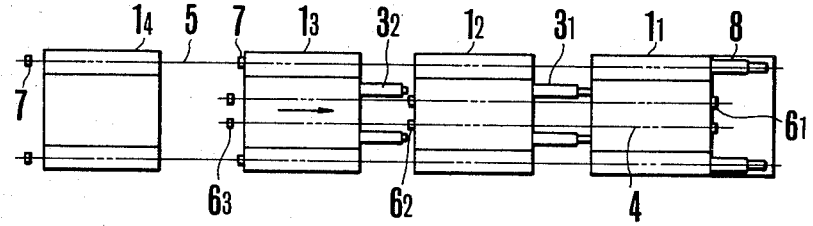
Figure 3E:
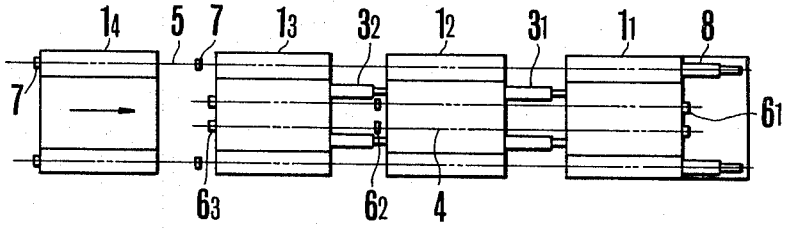

This embodiment is an underground structure constructing apparatus adapted for carrying out the method of Example 3 as shown in FIG. 3*a* and as will be defined in the appended claim 26. Referring to FIG. 3*a*, the apparatus comprises in combination: A pulling jack advancing arrangement 8 removably attached to the front part of a first cylindrical body $1_1$; thrusting jack advancing arrangements $3_1$ and $3_2$ which are disposed respectively between first and second cylindrical bodies $1_1$ and $1_2$ and between second and third cylindrical bodies $1_2$ and $1_3$ and are removably attached either to the rear of the first cylindrical body $1_1$ or to the front of the second cylindrical body $1_2$ and either to the rear of the second cylindrical body $1_2$ or to the front of the third cylindrical body $1_3$; traction members 5 which are arranged to pierce through the above stated pulling jack advancing arrangement 8, the first cylindrical body $1_1$ and all of cylindrical bodies disposed subsequently to the first one; attachable and detachable fixing pieces 7 which are attached to the traction members 5 at the head portion of the above stated pulling jack advancing arrangement 8 and between one and another among cylindrical bodies including the third one and those subsequent thereto; connecting members 4 arranged to pierce through each of the first, second and third cylindrical bodies $1_1$, $1_2$ and $1_3$; and attachable and detachable fasteners $6_1$, $6_2$ and $6_3$ attached to the connecting members 4 respectively in front of the first cylindrical body $1_1$, between the second and third ones $1_2$ and $1_3$ and in the rear of the third one $1_3$.

EXAMPLE 26

This embodiment is an underground structure constructing apparatus adapted for carrying out the method of Example 4 as shown in FIG. 4*a* and as will be defined in the appended claim 27. Referring to FIG. 4*a*, the apparatus comprises in combination: A pulling jack advancing arrangement 8 removably attached to the front part of a first cylindrical body $1_1$; thrusting jack advancing arrangements $3_1$ and $3_2$ which are respectively disposed between first and second cylindrical bodies $1_1$ and $1_2$ and between second and third cylindrical bodies $1_2$ and $1_3$ and are removably attached either to the rear of the first cylindrical body $1_1$ or to the front of the second cylindrical body $1_2$ and either to the rear of the second cylindrical body $1_2$ or to the front of the third cylindrical body $1_3$; traction members 5 which are arranged to pierce through the above stated pulling jack advancing arrangement 8, the first cylindrical body $1_1$ and all of cylindrical bodies disposed subsequently to the first one; and attachable and detachable fixing pieces 7 which are attached to the traction members 5 respectively at the head portion of the above stated pulling jack advancing arrangement 8 and between one and another of the cylindrical bodies among the third one and those disposed subsequently thereto.

EXAMPLE 27

This embodiment is an underground structure constructing apparatus adapted for carrying out the method of Example 5 as shown in FIG. 5*a* and as will be defined in the appended claim 28. Referring to FIG. 5*a*, the apparatus comprises in combination: A pulling/thrusting jack advancing arrangement 2 removably attached to the front of a third cylindrical body $1_3$ and is disposed between second and third cylindrical bodies $1_2$ and $1_3$; thrusting jack advancing arrangements $3_1$ and $3_3$ which are disposed respectively between first and second cylindrical bodies $1_1$ and $1_2$ and between third and fourth cylindrical bodies $1_3$ and $1_4$ and are removably attached respectively either to the rear of the first cylindrical body $1_1$ or to the front of the second cylindrical body $1_2$ and either to the rear of the third cylindrical body $1_3$ or to the front of the fourth cylindrical body $1_4$; traction members 5 which are arranged to pierce through the above stated pulling/thrusting jack advancing arrangement 2, the third cylindrical body $1_3$ and all of cylindrical bodies disposed subsequently to the third one; attachable and detachable fixing pieces $7_1$ and $7_2$ which are attached to the traction members 5 respectively at the head portion of the pulling/thrusting jack advancing arrangement 2 and between one cylindrical body and another among the fourth and subsequent cylindrical bodies; connecting members 4 which are arranged to pierce through each of the second cylindrical body $1_2$ and those subsequent thereto; and attachable and detachable fasteners $6_1$, $6_2$, $6_3$, . . . attached to the connecting members 4 respectively in front of the second cylindrical body $1_2$ and between one cylindrical body and another amont the third and subsequent cylindrical bodies.

EXAMPLE 28

This embodiment is an underground structure constructing apparatus adapted for carrying out the method of Example 6 as shown in FIG. 6 and as will be defined in the appended claim 29. Referring to FIG. 6, the apparatus comprises in combination: A pulling jack advancing arrangement 8 disposed between second and third cylindrical bodies $1_2$ and $1_3$ and is removably attached to the front of the third cylindrical body $1_3$; thrusting jack advancing arrangements $3_1$, $3_2$ and $3_3$ which are disposed respectively between one cylindrical body and another among first to fourth cylindrical bodies $1_1$–$1_4$ and are removably attached to the rears or fronts of these cylindrical bodies; traction members 5 which are arranged to pierce through the above stated pulling jack advancing arrangement 8, the third cylindrical body $1_3$ and all of cylindrical bodies disposed subsequently to the third one; attachable and detachable fixing pieces $7_1$, $7_2$, . . . which are attached to the traction members 5 respectively at the head portion of the pulling jack advancing arrangement 8 and between one and another of cylindrical bodies including the fourth one and those subsequent to the fourth one; connecting members 4 which are arranged to pierce through the second cylindrical body $1_2$ and all of cylindrical bodies disposed subsequently thereto; and attachable and detachable fasteners $6_1$, $6_2$, $6_3$, . . . which are attached to the connecting members 4 respectively in front of the second cylindrical body $1_2$ and between one and another among the third and subsequent cylindrical bodies.

EXAMPLE 29

Figure 7A:
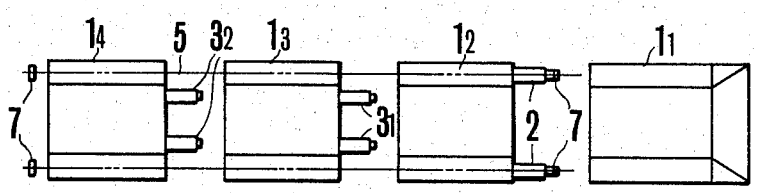
FIGS. 7*a*–7*e* are schematic views of Embodiment Example 7 showing the arrangement and the sequence of operation steps thereof.
Figure 7B:
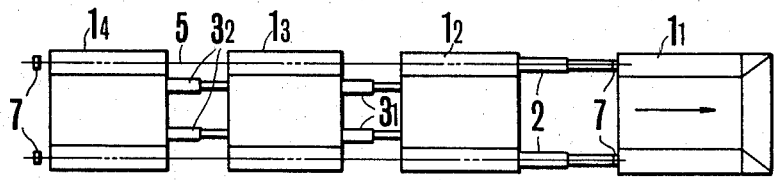
Figure 7C:
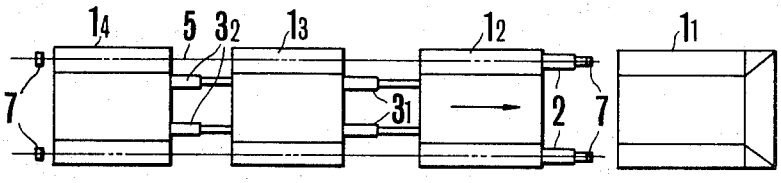
Figure 7D:
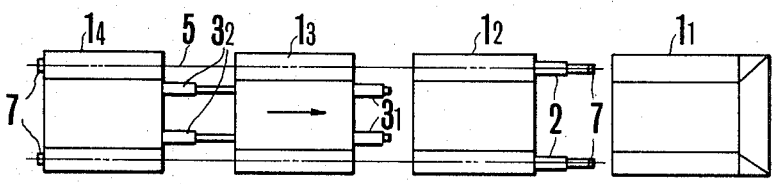
Figure 7E:
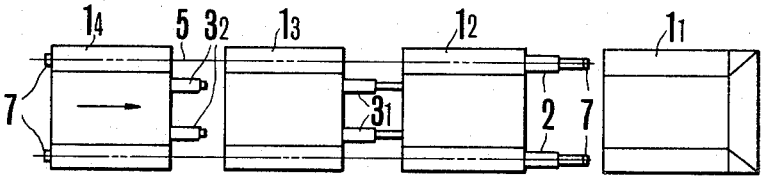

This embodiment is an underground structure constructing apparatus adapted for carrying out the method of Example 7 as shown in FIG. 7*a* and as will be defined in the appended claim 30. As shown in FIG. 7*a*, the apparatus comprises in combination: A pulling/thrusting jack advancing arrangement 2 disposed between first and second cylindrical bodies $1_1$ and $1_2$ and is removably attached to the front of the second cylindrical body $1_2$; thrusting jack advancing arrangements $3_1$ and $3_2$ which are disposed between one and another cylindrical bodies among second to fourth cylindrical bodies $1_2$, $1_3$ and $1_4$ and are removably attached either to the rears or to the fronts of them; traction members 5 which are arranged to pierce through the above stated pulling-thrusting jack advancing arrangement 2, the second cylindrical body $1_2$ and all of cylindrical bodies disposed subsequently thereto; and attachable and detachable fixing members 7 which are attached to the traction members 5 respectively at the head portion of the pulling/thrusting jack advancing arrangement and between one and another cylindrical bodies among the fourth and subsequent ones.

EXAMPLE 30

Figure 8:
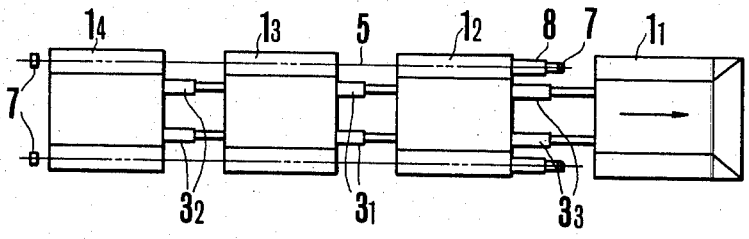
FIG. 8 is a schematic view of Embodiment Example 8 showing the arrangement thereof.

This embodiment is an underground structure constructing apparatus adapted for carrying out the method of Example 8 as shown in FIG. 8 and as will be defined in the appended claim 31. As shown in FIG. 8, the apparatus comprises in combination: A pulling jack advancing arrangement disposed between first and second cylindrical bodies $1_1$ and $1_2$ and is removably attached to the front of the second cylindrical body $1_2$; thrusting jack advancing arrangements $3_1$, $3_2$ and $3_3$ which are disposed between one and another cylindrical bodies among first through fourth cylindrical bodies $1_1$–$1_4$ and are removably attached either to the rears or to the fronts of them; traction members 5 which are arranged to pierce through the above stated pulling jack advancing arrangement 8, the second cylindrical body $1_2$ and all cylindrical bodies subsequent thereto; and attachable and detachable fixing pieces 7 which are attached to the traction members 5 respectively at the head portion of the pulling jack advancing arrangement 8 and between one and another cylindrical bodies among the fourth and subsequent ones.

EXAMPLE 31

This is an underground structure constructing apparatus adapted for carrying out the method of Example 9 as shown in FIG. 9*a* and as will be defined in the appended claim 32. Referring to FIG. 9*a*, the apparatus comprises in combination: A thrusting jack advancing arrangement 3 disposed between cylindrical bodies and is removably attached either to the rear of one cylindrical body or to the front of another; a pulling jack advancing arrangement $8_2$ removably attached either to the front of a first cylindrical body $1_1$ or to the rear of the hindmost cylindrical body; connecting members 4 which are arranged to pierce through the pulling jack advancing arrangement $8_2$ and the first cylindrical body $1_1$ and all of cylindrical bodies disposed subsequently thereto; attachable and detachable fasteners 6 which are attached to the connecting members 4 respectively at the head portion of the pulling jack advancing arrangement $8_2$ and either in front of the first cylindrical body $1_1$ or in the rear of the hindmost cylindrical body; a reaction facility 10 installed on one side of a natural ground opposite to the side thereof from which the cylindrical bodies are to be advanced; another pulling jack advancing arrangement $8_1$ removably attached either to the head portion of the reaction facility 10 or to the rear of the hindmost cylindrical body; traction members 5 which are arranged to pierce through the reaction facility 10, a horizontal hole 9 provided in the natural ground, the first cylindrical body $1_1$ and all of cylindrical bodies subsequent thereto and the pulling jack advancing arrangement $8_2$; and attachable and detachable fixing pieces 7 which are attached to the traction members 5 in front of the reaction facility 10 or in the rear of the hindmost cylindrical body and at the head portion of the pulling jack advancing arrangement $8_2$.

EXAMPLE 32

This is an underground structure constructing apparatus adapted for carrying out the method of Example 10 as shown in FIG. 10*a* and as will be defined in the appended claim 33. Referring to FIG. 10*a*, the apparatus comprises in combination: Thrusting jack advancing arrangements $3_1$, $3_2$, . . . disposed between one cylindrical body and another and are removably attached either to the fronts or rears of these cylindrical bodies; a pulling jack advancing arrangement $8_2$ removably attached either to the front of a first cylindrical body $1_1$ or to the rear of the hindmost cylindrical body; connecting members 4 which are arranged to pierce through the pulling jack advancing arrangement $8_2$, the first cylindrical body $1_1$ and all of cylindrical bodies subsequent thereto; attachable and detachable fasteners 6 which are attached to the connecting members 4 at the head portion of the pulling jack advancing arrangement $8_2$ and in front of the first cylindrical body $1_1$; a reaction facility 10 installed on one side of a natural ground opposite to the side thereof from which the cylindrical bodies are to be advanced; another pulling jack advancing arrangement $8_1$ removably attached to the front of the reaction facility 10; traction members 5 which are arranged to pierce through the reaction facility 10, a horizontal hole 9 provided in the natural ground, the first cylindrical body $1_1$ and all of cylindrical bodies subsequent thereto and the pulling jack advancing arrangement $8_2$; and attachable and detachable fixing pieces 7 which are attached to the traction members 5 at the head portion of the pulling jack advancing arrangement $8_1$, between one cylindrical body and another and in the rear of the hindmost cylindrical body.

EXAMPLE 33

This is an underground structure constructing apparatus adapted for carrying out the method of Example 11 as shown in FIG. 11 and as will be defined in the appended claim 34. Referring to FIG. 11, the apparatus is arranged in the same manner as the apparatuses of the preceding example which are adapted for carrying out the methods of Examples 9 and 10 (or claims 10 and 11) with the exception of that: The traction members 5 in this case are not only provided with a pulling/thrusting jack advancing arrangement at their one end but also provided with another set of pulling/thrusting jack advancing arrangement $8_1$ at the other end of them.

EXAMPLE 34

This is an underground structure constructing apparatus adapted for carrying out the method of Example 12 as shown in FIG. 12*a* and as will be defined in the appended claim 35. Referring to FIG. 12*a*, the apparatus comprises in combination: Thrusting jack advancing arrangements $3_1$, $3_2$, . . . disposed between one cylindrical body and another and are removably attached either to the fronts or rears of these cylindrical bodies; a pulling jack advancing arrangement $8_2$ removably attached to the front of a second cylindrical body $1_2$; connecting members which are arranged to pierce through the above stated pulling jack advancing arrangement $8_2$, the second cylindrical body $1_2$ and all of cylindrical bodies disposed subsequently thereto; attachable and detachable fasteners 6 connected to the connecting members 4 at the head portion of the pulling jack advancing arrangement $8_2$ and in the rear of the hindmost cylindrical body; a reaction facility 10 installed on one side of a natural ground opposite to the side thereof from which the cylindrical bodies are to be advanced; another pulling jack advancing arrangement $8_1$ removably attached to the front of the reaction facility 10; traction members 5 which are arranged to pierce through the pulling jack advancing arrangement $8_1$, the reaction facility 10, a horizontal hole 9 which is provided beforehand in the natural ground, the first cylindrical body and all of cylindrical bodies disposed subsequently thereto; and attachable and detachable fixing pieces 7 which are attached to the traction members 5 at the head portion of the pulling jack advancing arrangement $8_1$, between one cylindrical body and another among the first and subsequent cylindrical bodies and in the rear of the hindmost cylindrical body.

EXAMPLE 35

This embodiment example is an underground structure constructing apparatus adapted for carrying out the method of Example 13 as shown in FIG. 13*a* and as will be defined in the appended claim 36. Referring to FIG. 13*a*, the apparatus of this embodiment example is arranged in the same manner as the apparatus of Example 33 with the exception of that: The pulling jack advancing arrangement $8_2$ which is disposed between the first and second cylindrical bodies $1_1$ and $1_2$ in the apparatus of Example 33 is replaced with a pulling/thrusting jack advancing arrangement 2 in this case.

EXAMPLE 36

Figure 14:
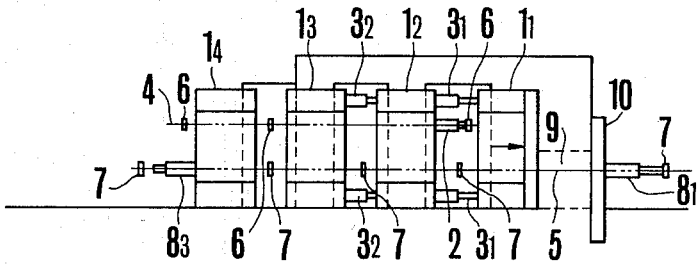
FIG. 14 is a schematic view of Embodiment Example 14 showing the arrangement thereof.

This is an underground structure constructing apparatus adapted for carrying out the method of Example 14 as shown in FIG. 14 and as will be defined in the appended claim 37. The apparatus of this embodiment example is arranged in the same manner as the apparatus of Example 34 with the exception of that: An additional pulling jack advancing arrangement $8_3$ is disposed between the rear of the hindmost cylindrical body and the fixing pieces 7 and is removably engaged with the traction members 5.

EXAMPLE 37

This is an underground structure constructing apparatus adapted for carrying out the method of Example 15 as shown in FIG. 15*a* and as will be defined in the appended claim 38. Referring to FIG. 15*a*, the apparatus comprises in combination: Traction members 5 arranged to pierce through two groups of more than two cylindrical bodies disposed on first and second start bases confronting each other across a natural ground where an underground structure is to be constructed and through a horizontal hole 9 which is provided in the natural ground beforehand; a pulling jack advancing arrangement $8_1$ disposed in the rear of the outermost of the cylindrical body group disposed on the second start base and is removably attached to the traction member 5; attachable and detachable fixing pieces 7 which are attached to the traction members 5 between one cylindrical body and another among the cylindrical body group disposed on the first start base and in the rear of the outermost cylindrical body of the same group; thrusting jack advancing arrangements $3_1$, $3_2$, . . . removably attached to cylindrical bodies of the group on the first start base having the fixing pieces 7 attached to the traction members 5; intermediate members 11 attachably and detachably installed in between one cylindrical body and another on the second start base; another pulling jack advancing arrangement $8_2$ attachably and detachably attached either to the front of the foremost cylindrical body or to the rear of the hindmost one of the cylindrical body group on the first start base, or the group having the above stated thrusting jack advancing arrangements $3_1$, $3_2$, . . . attached to the cylindrical bodies group, connecting members 4 which are arranged to pierce through the whole cylindrical body group on the first start base and the pulling jack advancing arrangement $8_2$; and attachable and detachable fasteners 6 attached to both ends of these connecting members 4.

EXAMPLE 38

Figure 16:
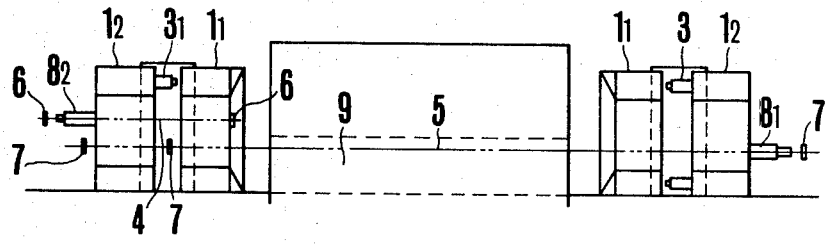
FIG. 16 is a schematic view of Embodiment Example 16 showing the arrangement thereof.

This is an underground structure constructing apparatus adapted for carrying out the method of Example 16 as shown in FIG. 16 and as will be defined in the appended claim 39. Referring to FIG. 16, the apparatus of this embodiment example is arranged in the same manner as the apparatus of Example 37 with the exception of that: The intermediate members 11 which are used in Example 37 are replaced with a thrusting jack advancing arrangement 3.

EXAMPLE 39

Figure 17:
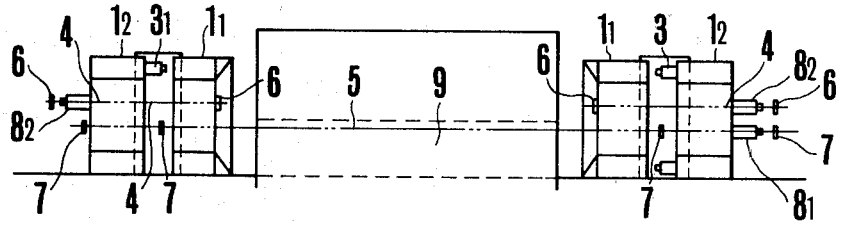
FIGS. 17, 18 and 19 are schematic views respectively showing the arrangement of Embodiment Examples 17, 18 and 19.

This is an underground structure constructing apparatus adapted for carrying out the method of Example 17 as shown in FIG. 17 and as will be defined in the appended claim 40. As shown in FIG. 17, the apparatus of this embodiment example is arranged in the same manner as in Example 37 with the exception of that: The intermediate members 11 used in the Example 37 are replaced with a thrusting jack advancing arrangement 3; another pulling jack advancing arrangement $8_2$ is attachably and detachably attached to the front of the foremost one or to the rear of the hindmost one of the cylindrical body group on the same start base; and attachable and detachable fixing pieces 7 are further attached to the traction members between one cylindrical body and another among the same cylindrical body group disposed on the second start base.

EXAMPLE 40

Figure 18:
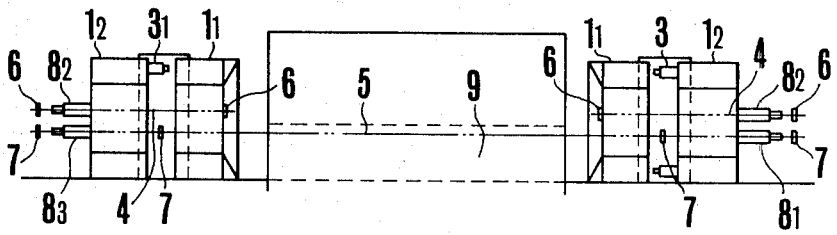

This is an underground structure constructing apparatus adapted for carrying out the method of Example 18 as shown in FIG. 18 and as will be defined in the appended claim 41. As shown in FIG. 18, the apparatus is arranged in the same manner as in Examples 37, 38 and 39 with the exception of that: An additional pulling jack advancing arrangement $8_3$ is attachably and detachably attached to one end of the traction members in the rear of the hindmost cylindrical body in the same manner as the other end of the traction members.

EXAMPLE 41

This is an underground structure constructing apparatus adapted for carrying out the method of Example 19 as shown in FIG. 19 and as will be defined in the appended claim 42. As shown in FIG. 19, the apparatus is arranged in the same manner as in Examples 37, 38, 39 and 40 with the exception of that: The thrusting jack advancing arrangements $3_1$, $3_2$, . . . , the fixing pieces 7 and the fasteners 6 disposed between one cylindrical body and another are arranged to be placed within cutaway parts 12 which are provided in these cylindrical bodies.

What is claimed is:

1. A method for constructing an underground structure by advancing underground a plurality of serially adjoining cylindrical bodies one after another, wherein a reaction force required for advancing each cylindrical body is obtained from the sum of reaction forces available from other cylindrical bodies and/or a reaction facility additionally provided; a cylindrical body pushing facility is formed with a thrusting jack advancing arrangement provided between selected ones of said cylindrical bodies; a cylindrical body connecting facility is formed with connecting members arranged to pierce through a required number of said serially adjoining cylindrical bodies, with fasteners attached to the connecting members at required points and with a pulling jack advancing arrangement or a pulling/thrusting jack advancing arrangement arranged to engage said cylindrical bodies; a pulling facility is formed with traction members arranged to pierce through a first group of a required number of cylindrical bodies, through a reaction facility or a second group of cylindrical bodies disposed on one side opposite to the side on which the first group are disposed and through a horizontal hole or the like arranged underground beforehand across a distance between said two sides, said traction members being provided with fixing pieces and a pulling jack advancing arrangement or a pulling/thrusting jack advancing arrangement which are attached thereto and are arranged to engage said cylindrical bodies and said reaction facility at desired points; the advancing facilities including said pushing, connecting and pulling facilities are operated as desired to have said cylindrical bodies moved forward underground one by one; then said advancing facilities are removed; and a cylindrical structure is constructed underground either by unifying said cylindrical bodies with each other or by having the cylindrical bodies installed on both ends of the underground structure with intermediate portion thereof constructed by a suitable conventional construction method.

2. A method for constructing an underground structure according to claim 1, wherein facilities for advancing more than three serially adjoining cylindrical bodies are arranged by having a pulling/thrusting jack advancing arrangement disposed between first and second cylindrical bodies, a thrusting jack advancing arrangement disposed between second and third cylindrical bodies, traction members arranged to pierce through said pulling/thrusting jack advancing arrangement, the second cylindrical body and each of cylindrical bodies subsequent thereto, attachable and detachable fixing pieces attached to said traction members in front of the pulling/thrusting jack advancing arrangement in the rear of each of the third and subsequent cylindrical bodies, connecting members arranged to pierce through the first, second and third cylindrical bodies and attachable and detachable fasteners attached to said connecting members in front of the first cylindrical body and in the rear of each of the second and third cylindrical bodies; in a first step of operation, the fasteners disposed in the rear of the second and third cylindrical bodies and the fixing pieces disposed in the rear of each of the third and subsequent cylindrical bodies are set free and then said pulling/thrusting jack advancing arrangement is operated to push forward the first cylindrical body with a reaction required for this obtained from the sum of reaction forces available from the second and third cylindrical bodies through the thrusting jack advancing arrangement disposed between the second and third cylindrical bodies; in a second step of operation, the fixing pieces disposed in the rear of one of the third and subsequent cylindrical bodies to be advanced and in front of the pulling/thrusting jack advancing arrangement are fixed to the traction members while the fixing pieces disposed in rear of other cylindrical bodies are set free and then, by fixing the fasteners disposed in front of the first cylindrical body and in rear of the second cylindrical body to the connecting members, the pulling/thrusting jack advancing arrangement is operated to have each of the third and subsequent cylindrical bodies pulled forward one after another with a reaction force required for the pulling operation obtained from the sum of the reaction forces available from the first and second cylindrical bodies; in a third step of operation, the fasteners disposed in front of the first cylindrical body and in the rear of the third cylindrical body are fixed to the connecting members and then the thrusting jack advancing arrangement disposed between the second and third cylindrical bodies is operated to have the second cylindrical body pushed forward with a reaction force required for this pushing operation obtained from the sum of the reaction forces of the first and third cylindrical bodies; and the more than three serially adjoining cylindrical bodies are advanced underground by repeating said three steps of operation as required.

3. A method for constructing an underground structure according to claim 1, wherein said cylindrical body advancing facilities are arranged to have more than four serially adjoining cylindrical bodies advanced underground with thrusting jack advancing arrangements disposed between the first and second cylindrical bodies and between the third and fourth cylindrical bodies, a pulling/thrusting jack advancing arrangement disposed between the second and third cylindrical bodies, the traction members arranged to pierce through said pulling/thrusting jack advancing arrangement and each of the third and subsequent cylindrical bodies, said attachable and detachable fixing pieces attached to said traction members in front of the pulling/thrusting jack advancing arrangement and in the rear of each of the fourth and subsequent cylindrical bodies, said connecting members arranged to pierce through and protrude from the second, third and fourth cylindrical bodies, and said attachable and detachable fasteners attached to the connecting members in front of the second cylindrical body and in the rear of each of the third and fourth cylindrical bodies; in a first step of operation, the thrusting jack advancing arrangement which is disposed between the first and second cylindrical bodies is operated to have the first cylindrical body moved forward with a reaction force required for this obtained from the sum of the reaction forces of the second and third cylindrical bodies or of the second, third and fourth cylindrical bodies available through the various jack advancing arrangements disposed between the second and third cylindrical bodies or the second, third and fourth cylindrical bodies; in a second step of operation, the pulling/-thrusting jack advancing arrangement which is disposed between the second and third cylindrical bodies is operated to have the second cylindrical body pushed forward with a reaction force required for this pushing operation obtained from the sum of the reaction forces of the third and fourth cylindrical bodies which are available through the thrusting jack advancing arrangement disposed between the third and fourth cylindrical bodies; in a third step of operation, with said fixing pieces fixed to said traction members in the rear of one of the fourth and subsequent cylindrical bodies to be advanced and in front of the pulling/thrusting jack advancing arrangement, while other fixing pieces disposed in other places are set free, and with the fasteners fixed to said connecting members in front of the second cylindrical body and in the rear of the third cylindrical body, the pulling/thrusting jack advancing arrangement which is disposed between the second and third cylindrical bodies is operated to have each of the fourth and subsequent cylindrical bodies pulled forward one by one with a reaction force required for the pulling operation obtained from the sum of reaction forces of the second and third cylindrical bodies; in a fourth step of operation, the fasteners disposed in front of the second cylindrical body and in the rear of the third cylindrical body are fixed to the connecting members and the thrusting jack advancing arrangement which is disposed between the second and third cylindrical bodies is operated to push forward the third cylindrical body with a reaction force required for this obtained from the sum of the reaction forces of the second and fourth cylindrical bodies; and said more than four serially adjoining cylindrical bodies are advanced underground by repeating said steps of operation as desired.

4. A method for constructing an underground structure according to claim 1, wherein said cylindrical body advancing facilities are arranged to have more than four serially adjoining cylindrical bodies advanced underground with a pulling/thrusting jack advancing arrangement disposed between first and second cylindrical bodies, thrusting jack advancing arrangements disposed respectively between second and third cylindrical bodies and between third and fourth cylindrical bodies, said traction members arranged to pierce through and protrude from said pulling/thrusting jack advancing arrangement and each of the second and subsequent cylindrical bodies, and said attachable and detachable fixing pieces attached to the traction members in front of the pulling/thrusting jack advancing arrangement and in the rear of each of the fourth and subsequent cylindrical bodies; then, in a first step of operation, the pulling/thrusting jack advancing arrangement disposed between the second and third cylindrical bodies is operated to have the first cylindrical body pushed forward with a reaction force required for this pushing operation obtained from the sum of the reaction forces of the second and third cylindrical bodies or the second, third and fourth cylindrical bodies through the thrusting jack advancing arrangement disposed between the second and third cylindrical bodies or through the thrusting jack advancing arrangements disposed between the second and third cylindrical bodies and between the third and fourth cylindrical bodies; in a second step of operation, the thrusting jack advancing arrangement disposed between the second and third cylindrical bodies is operated to push forward the second cylindrical body with a reaction force required for this obtained from the sum of the reaction forces of the third and fourth cylindrical bodies through the thrusting jack advancing arrangement disposed between the third and fourth cylindrical bodies; in a third step of operation, the fixing pieces disposed in the rear of some of the fourth and subsequent cylindrical bodies and in front of the pulling/thrusting jack advancing arrangement are fixed to the traction members and then the thrusting jack advancing arrangement disposed between the third and fourth cylindrical bodies is operated to push forward the third cylindrical body with a reaction force required for this pushing operation obtained from the sum of the reaction forces of the second cylindrical body and said some of the fourth and subsequent cylindrical bodies; in a fourth step of operation, the fixing pieces disposed in front of the pulling/thrusting jack advancing arrangement and in the rear of one of the fourth and subsequent cylindrical bodies to be advanced are fixed to the traction members while other fixing pieces are set free and then the pulling jack advancing arrangement is operated to have each of the fourth and subsequent cylindrical bodies pulled forward one by one with a reaction force required for this obtained from the sum of the reaction forces of the second and third cylindrical bodies through the thrusting jack advancing arrangement disposed between the second and third cylindrical bodies; and the more than four serially adjoining cylindrical bodies are advanced underground by repeating said steps of operation as desired.

5. A method for constructing an underground structure according to claim 1, wherein said cylindrical body advancing facilities are arranged such that: there is provided a horizontal hole piercing through a natural ground between a start base and an arrival base to have the two bases communicating with each other; a reaction facility is installed on the arrival base while more than two cylindrical bodies are disposed on the start base; said traction members are arranged to pierce through the reaction facility, the horizontal hole and the cylindrical bodies, the traction members further piercing through a first pulling jack advancing arrangement which is either attached to the rear of the hindmost cylindrical body or to the front of the reaction facility; attachable and detachable said fixing pieces are attached to both ends of the traction members; a thrusting jack advancing arrangement is disposed between each cylindrical body and another; said connecting members are arranged to pierce through and protrude from more than two cylindrical bodies disposed ahead of the hindmost one; said fasteners are attached to the connecting members and are disposed in front of the cylindrical bodies to be connected; a second pulling jack advancing arrangement which is provided with said fixing pieces is disposed in the rear of the hindmost of the more than two cylindrical bodies, then, with the advancing facilities for the more than two cylindrical bodies arranged in the above stated manner, in a first step of operation, the thrusting jack advancing arrangement disposed in the rear of each cylindrical body is operated to move forward the cylindrical bodies other then the hindmost one by one with a reaction force required for this operation obtained from the sum of the reaction forces available from subsequent cylindrical bodies and a reaction force available from the reaction facility through the traction members; in a second step of operation, the first and second pulling jack advancing arrangements are jointly operated to have the hindmost cylindrical body moved forward with a reaction force required for this obtained from the sum of the reaction force of the reaction facility available through the traction members and the reaction force of one or a plurality of cylindrical bodies connected to each other by the fasteners of the connecting members; and the more than two serially adjoining cylindrical bodies are advanced underground by repeating these steps of operation as desired.

6. A method according to claim 1 or 5, wherein said attachable and detachable fixing pieces which are provided in combination with said traction members are not only disposed at the hindmost cylindrical body but also additionally disposed in the rear of each cylindrical body other than the hindmost one to make an additional source of reaction available during an advancing operation on each cylindrical body other than the hindmost one and wherein; in the first step of operation, the cylindrical bodies other than the hindmost one are moved forward one by one, with the fixing pieces which are disposed between cylindrical bodies fixed or set free, by operating the thrusting jack advancing arrangement and the pulling jack advancing arrangement; in the second step of operation, the hindmost cylindrical body is advanced in the same manner as the second step of claim 10.

7. A method according to claim 5 or 6, wherein a first pulling jack advancing arrangement is provided with the fixing pieces to have first pulling jack advancing arrangements disposed at both ends of the traction members; and the elongation and slack of the traction members which happens during a cylindrical body pulling operation is arranged to be absorbed by operating either of the two pulling jack advancing arrangement.

8. A method according to claim 5 wherein, with said horizontal hole arranged to have the start base and the arrival base communicating with each other and with the reaction facility installed on the arrival base, the traction members are arranged to pierce through more than three cylindrical bodies disposed on the start base, the horizontal hole and the reaction facility; then a first pulling jack advancing arrangement which is provided with fixing pieces attachable to and detachable from the traction members is disposed in front of the reaction facility; further fixing pieces are attached to the traction members and are disposed in the rear of each cylindrical body; thrusting jack advancing arrangements are disposed respectively between the first and second cylindrical bodies and between the second and third cylindrical bodies; the connecting members are arranged to pierce through and protrude from each of the second and subsequent cylindrical bodies, then, in combination with the connecting members, a second pulling jack advancing arrangement which is provided with fasteners attachable to and detachable from the connecting members is disposed in front of the second cylindrical body while other fasteners are disposed in the rear of each of the third and subsequent cylindrical bodies; with the facilities for advancing more than three cylindrical bodies arranged in the above stated manner, in the first step of operation, the thrusting jack advancing arrangement disposed between the first and second cylindrical bodies is operated to have the first cylindrical body pushed forward with a reaction force required for this obtained from the sum of the reaction forces available from the second and third cylindrical bodies through the thrusting jack advancing arrangement disposed between the second and third cylindrical bodies; meanwhile, concurrently with the pushing operation, the fixing pieces disposed in the rear of the first cylindrical body is fixed to the traction members while other fixing pieces disposed in rear of other cylindrical bodies are set free and then the first pulling jack advancing arrangement is also operated to have the first cylindrical body pulled forward through the traction member; in the second step of operation, while the second cylindrical body is pushed by operating the thrusting jack advancing arrangement disposed between the second and third cylindrical bodies with a required reaction force obtained from the third cylindrical body, the fixing pieces disposed in the rear of the second cylindrical body is fixed to the traction members, with other fixing pieces which are disposed in the rear of each of other cylindrical bodies set free, and the first pulling jack advancing arrangement is also operated to have the second cylindrical body pulled forward; in the third step of operation, the fixing pieces and the fasteners disposed in the rear of each of the third and subsequent cylindrical bodies to be advanced are fixed to the traction members and the connecting members while the fixing pieces and fasteners disposed in rear of other cylindrical bodies are set free and then the first and second pulling jack advancing arrangements are jointly operated to move forward each of the third and subsequent cylindrical bodies; and the more than three serially adjoining cylindrical bodies are advanced underground one after another by repeating the first, second and third steps of operation as desired.

9. A method for constructing an underground structure according to claim 1, wherein said cylindrical body advancing facilities are arranged such that a horizontal hole is arranged to connect first and second start bases which confront each other at a predetermined distance; said traction members are arranged to pierce through and protrude from the horizontal hole and more than two cylindrical bodies disposed on each of the start bases; attachable and detachable fixing pieces are attached to the traction members in the rear of each of the cylindrical bodies disposed on the first start base while a first pulling jack advancing arrangement which is provided with the same kind of fixing pieces is disposed in the rear of the hindmost cylindrical body disposed on the second start base; between each cylindrical body and another disposed on the first start base, there is disposed a thrusting jack advancing arrangement while intermediate members are interposed in between each cylindrical body and another disposed on the second start base; said connecting members are arranged to pierce through and protrude from more than two cylindrical bodies disposed in the rear part of the group of cylindrical bodies aligned on the first start base; attachable and detachable fasteners are attached to the connecting members in front of each of more than one cylindrical body disposed ahead of the hindmost one on the first start base while, in the rear of the hindmost one, there is disposed a second pulling jack advancing arrangement which is provided with fasteners of the same kind for fixing the connecting members there; then, with advancing facilities for the confronting two groups each consisting of more than two cylindrical bodies arranged in the above stated manner, in a first step of operation, the fixing pieces disposed in the rear of one cylindrical body to be advanced among cylindrical bodies other than the hindmost one on the first start base are fixed to the traction members while other fixing pieces are set free and then, with the fasteners of the second pulling jack advancing arrangement set free from the connecting members, the first pulling jack advancing arrangement is operated to have each of the cylindrical bodies of the first start base other than the hindmost one pulled forward; then, at the same time, the thrusting jack advancing arrangement disposed in the rear of the cylindrical body to be advanced is also operated to push the cylindrical body forward; in a second step of operation, the fixing pieces disposed in the rear of the hindmost cylindrical body are fixed to the traction members while other fixing pieces are set free and then, with fasteners fixed to the connecting members, the first and second pulling jack advancing arrangements are jointly operated to have the hindmost cylindrical body pulled forward; when the cylindrical bodies disposed on the first start base have been moved forward to a desired underground point by repeating the first and second steps as necessary, the cylindrical body advancing facilities of one start base are interchanged with those of the other base; and the group of cylindrical bodies on the second start base are advanced to an underground point in the same manner as set forth in the foregoing for construction of an underground structure.

10. A method for constructing an underground structure according to claim 1 wherein said cylindrical body advancing facilities are arranged such that a horizontal hole is arranged to connect first and second start bases which confront each other at a predetermined distance; said traction members are arranged to pierce through and protrude from the horizontal hole and more than two cylindrical bodies disposed on each of the start bases; attachable and detachable fixing pieces are attached to the traction members in the rear of each of the cylindrical bodies disposed on the first start base while a first pulling jack advancing arrangement which is provided with the same kind of fixing pieces is disposed in the rear of the hindmost cylindrical body disposed on the second start base; between each cylindrical body and another disposed on the first start base, there is disposed a thrusting jack advancing arrangement while intermediate members are interposed inbetween each cylindrical body and another thrusting jack advancing arrangement is disposed on the second start base; said connecting members are arranged to pierce through and protrude from more than two cylindrical bodies disposed in the rear part of the group of cylindrical bodies aligned on the first start base; attachable and detachable fasteners are attached to the connecting members in front of each of more than one cylindrical body disposed ahead of the hindmost one on the first start base while, in the rear of the hindmost one, there is disposed a second pulling jack advancing arrangement which is provided with fasteners of the same kind for fixing the connecting members there; then, with advancing facilities for the confronting two groups each consisting of more than two cylindrical bodies arranged in the above stated manner, in a first step of operation, the fixing pieces disposed in the rear of one cylindrical body to be advanced among cylindrical bodies other than the hindmost one on the first start base are fixed to the traction members while other fixing pieces are set free and then, with the fasteners of the second pulling jack advancing arrangement set free from the connecting members, the first pulling jack advancing arrangement is operated to have each of the cylindrical bodies of the first start base other than the hindmost one pulled forward; then, at the same time, the thrusting jack advancing arrangement disposed in the rear of the cylindrical body to be advanced is also operated to push the cylindrical body forward; in a second step of operation, the fixing pieces disposed in the rear of the hindmost cylindrical body are fixed to the traction members while other fixing pieces are set free and then, with fasteners fixed to the connecting members, the first and second pulling jack advancing arrangements are jointly operated to have the hindmost cylindrical body pulled forward; when the cylindrical bodies disposed on the first start base have been moved forward to a desired underground point by repeating the first and second steps as necessary, the cylindrical body groups on both start bases are advanced in the same manner as the first and second steps set forth above and the group of cylindrical bodies on the second start base are advanced to an underground point in the same manner as set forth in the foregoing for construction of an underground structure.

11. A method for constructing an underground structure according to claim 1 wherein said cylindrical body advancing facilities are arranged such that a horizontal hole is arranged to connect first and second start bases which confront each other at a predetermined distance; said traction members are arranged to pierce through and protrude from the horizontal hole and more than two cylindrical bodies disposed on each of the start bases; attachable and detachable fixing pieces are attached to the traction members in the rear of each of the cylindrical bodies disposed on the first start base while a first pulling jack advancing arrangement which is provided with the same kind of fixing pieces is disposed in the rear of the hindmost cylindrical body disposed on the second start base; between each cylindrical body and another disposed on the first start base, there is disposed a thrusting jack advancing arrangement while cut-away parts are provided in each cylindrical body for accomodating the thrusting jack advancing arrangement, fixing pieces and fasteners disposed between one cylindrical body and another; said connecting members are arranged to pierce through and protrude from more than two cylindrical bodies disposed in the rear part of the group of cylindrical bodies aligned on the first start base; attachable and detachable fasteners are attached to the connecting members in front of each of more than one cylindrical body disposed ahead of the hindmost one on the first start base while, in the rear of the hindmost one, there is disposed a second pulling jack advancing arrangement which is provided with fasteners of the same kind for fixing the connecting members there; then, with advancing facilities for the confronting two groups each consisting of more than two cylindrical bodies arranged in the above stated manner, in a first step of operation, the fixing pieces disposed in the rear of one cylindrical body to be advanced among cylindrical bodies other than the hindmost one on the first start base are fixed to the traction members while other fixing pieces are set free and then, with the fasteners of the second pulling jack advancing arrangement set free from the connecting members, the first pulling jack advancing arrangement is operated to have each of the cylindrical bodies of the first start base other than the hindmost one pulled forward; then, at the same time, the thrusting jack advancing arrangement disposed in the rear of the cylindrical body to be advanced is also operated to push the cylindrical body forward; in a second step of operation, the fixing pieces disposed in the rear of the hindmost cylindrical body are fixed to the traction members while other fixing pieces are set free and then, with fasteners fixed to the connecting members, the first and second pulling jack advancing arrangements are jointly operated to have the hindmost cylindrical body pulled forward; when the cylindrical bodies disposed on the first start base have been moved forward to a desired underground point by repeating the first and second steps as necessary, the cylindrical body advancing facilities of one start base are interchanged with those of the other base; and the group of cylindrical bodies on the second start base are advanced to an underground point in the same manner as set forth in the foregoing for construction of an underground structure.

12. An underground structure constructing apparatus adapted for advancing successively adjoining cylindrical bodies, said apparatus comprising in combination:

traction members arranged to pierce through two groups each consisting of more than two cylindrical bodies on first and second start bases confronting each other across a natural ground where said underground structure is to be constructed and through a horizontal hole which is provided in the natural ground beforehand;

a pulling jack advancing arrangement disposed in the rear of the outermost of the cylindrical body group disposed on the second start base and is removably attached to the traction members;

attachable and detachable fixing pieces which are attached to the traction members between one cylindrical body and another among the group of cylindrical bodies disposed on the first start base and in the rear of the outermost cylindrical body of the same group;

thrusting jack advancing arrangement which are removably attached to cylindrical bodies of the group aligned on the start base having the fixing pieces attached to the traction members;

another thrusting jack advancing arrangement installed in between one cylindrical body and another on the second start base;

another pulling jack advancing arrangement attachably and detachably attached either to the front of the foremost cylindrical body or to the rear of the hindmost of the cylindrical body group disposed on the first start base, or the group having said thrusting jack advancing arrangements attached to cylindrical bodies;

connecting members which are arranged to pierce through the whole cylindrical body group on the first start base and the pulling jack advancing arrangement; and attachable and detachable fasteners attached to both ends of said connecting members.

13. A method according to claim 10 wherein the cylindrical body groups aligned on the second start base are provided with the same connecting members and fasteners as those used on the first start base and also with a second pulling jack advancing arrangement; in addition to that, the traction members are provided with further fixing pieces which are disposed between one cylindrical body and another on the second start base; and the two groups of cylindrical bodies on the two start bases are respectively advanced underground without interchanging transfer of the connecting members, fasteners and the second pulling jack advancing arrangement from one start base to the other.

14. A method according to claim 13 wherein with said fixing pieces which are disposed in the rear of the hindmost cylindrical body for fixing said traction members there on the first start base there is provided a first pulling jack advancing arrangement; and wherein with the cylindrical body advancing facilities arranged in this manner, the elongation and slack of the traction members are absorbed by operating either of the two first pulling jack advancing arrangements at each step of the cylindrical body advancing operation.

15. A method for constructing an underground structure according to claim 1, wherein advancing facilities for advancing more than three serially adjoining cylindrical bodies underground in a self-running manner are arranged are operated such that, with the cylindrical body group provided with an excavating and boring facility, there are advanced underground with excavation and boring in the self-running manner; when the hindmost of the cylindrical bodies comes to a predetermined underground point, the hindmost one is left there while other cylindrical bodies are further advanced underground with excavation and boring to leave an underground space behind them; and then, when the underground space reaches a suitable length, an underground structure of a desired shape is constructed within the underground space.

16. A method according to claim 1 or 15, wherein said group of cylindrical bodies is a group of more than four cylindrical bodies; and wherein more than one cylindrical body disposed in the rear part of the cylindrical body group are left at an underground point near the entrance of an excavating hole and are used as a part of an underground structure to be constructed; meanwhile more than three other cylindrical bodies are allowed to be further advanced underground; and the underground structure is constructed gradually within an underground space created in front of the cylindrical body or bodies left near the entrance according as other cylindrical bodies are advanced further.

17. A method according to claim 15 or 16, wherein said more cylindrical bodies which are further advanced underground in the self-running manner with excavation are also arranged to be used as a part of the underground structure with the self-running advancing facilities removed therefrom upon completion of the advancing operation.

18. An underground structure constructing apparatus adapted for advancing successively adjoining cylindrical bodies, said apparatus comprising in combination:

a pulling/thrusting jack advancing arrangement disposed between the first and second cylindrical bodies and is detachably attached to the front of said second cylindrical body;

a thrusting jack advancing arrangement disposed between second and third cylindrical bodies and is detachably attached either to the rear of the second cylindrical body or to the front of the third cylindrical body;

traction members arranged to pierce through said pulling/thrusting jack advancing arrangement, the second cylindrical body and every cylindrical body disposed subsequently to the second one;

attachable and detachable fixing pieces attached to said traction members at the head portion of said pulling/-thrusting jack advancing arrangement and between one cylindrical body and another among the third and subsequent cylindrical bodies;

connecting members arranged to pierce through the first, second and third cylindrical bodies; and attachable and detachable fasteners attached to said connecting members in front of the first cylindrical body, between the second and third ones and in the rear of the third one.

19. An underground structure constructing apparatus adapted for advancing successively adjoining cylindrical bodies, said apparatus comprising in combination:

a pulling jack advancing arrangement removably attached to the front of a second cylindrical body and disposed between first and second cylindrical bodies;

thrusting jack advancing arrangements which are disposed respectively between the first and second cylindrical bodies and between the second and third cylindrical bodies, said thrusting jack advancing arrangements being removably attached either to the rear of the first cylindrical body or the front of the second one and either to the rear of the second cylindrical body or to the front of the third cylindrical body respectively;

traction members arranged to pierce through said pulling jack advancing arrangement, the second cylindrical body and every cylindrical body subsequent thereto;

attachable and detachable fixing pieces attached to the traction members and are disposed at the head portion of the pulling jack advancing arrangement and between one cylindrical body and another among the third and subsequent cylindrical bodies;

connecting members arranged to pierce through each of the first, second and third cylindrical bodies; and attachable and detachable fasteners attached to the connecting members respectively in front of the first cylindrical body, between the second and third cylindrical bodies and in the rear of the third cylindrical body.

20. An underground structure constructing apparatus adapted for advancing successively adjoining cylindrical bodies, said apparatus comprising in combination:

a pulling jack advancing arrangement removably attached to the front part of a first cylindrical body;

thrusting jack advancing arrangements which are disposed respectively between first and second cylindrical bodies and between second and third cylindrical bodies, said thrusting jack advancing arrangements being removably attached either to the rear of the first cylindrical body or to the front of the second cylindrical body and either to the rear of the second cylindrical body or to the front of the third cylindrical body;

traction members which are arranged to pierce through said pulling jack advancing arrangement, the first cylindrical body and every cylindrical body disposed subsequently to the first one;

attachable and detachable fixing pieces which are attached to the traction members at the head portion of said pulling jack advancing arrangement and between one cylindrical body and another among the third and subsequent cylindrical bodies;

connecting members which are arranged to pierce through each of the first, second and third cylindrical bodies; and attachable and detachable fasteners attached to the connecting members respectively in front of the first cylindrical body, between the second and third ones and in the rear of the third cylindrical body.

21. An underground structure constructing apparatus adapted for advancing successively adjoining cylindrical bodies, said apparatus comprising in combination:

a pulling jack advancing arrangement removably attached to the front part of a first cylindrical body;

thrusting jack advancing arrangements which are respectively disposed between first and second cylindrical bodies and between second and third cylindrical bodies, said thrusting jack advancing arrangements being removably attached either to the rear of the first cylindrical body or to the front of the second cylindrical body and either to the rear of the second cylindrical body or to the front of the third cylindrical body;

traction members which are arranged to pierce through said pulling jack advancing arrangement, the first cylindrical body and every cylindrical body disposed subsequently to the first one; and attachable and detachable fixing pieces which are attached to the traction members respectively at the head portion of the pulling jack advancing arrangement and between one cylindrical body and another among the third one and subsequent cylindrical bodies.

22. An underground structure constructing apparatus adapted for advancing successively adjoining cylindrical bodies, said apparatus comprising in combination:

a pulling/thrusting jack advancing arrangement removably attached to the front of a third cylindrical body and is disposed between second and third cylindrical bodies;

thrusting jack advancing arrangements which are disposed respectively between first and second cylindrical bodies and between third and fourth cylindrical bodies, said thrusting jack advancing arrangement being removably attached respectively either to the rear of the first cylindrical body or to the front of the second cylindrical body and either to the rear of the third cylindrical body or to the front of the fourth cylindrical body;

traction members which are arranged to pierce through the pulling/thrusting jack advancing arrangement, the third cylindrical body and every cylindrical body disposed subsequently to the third cylindrical body;

attachable and detachable fixing pieces which are attached to the traction members respectively at the head portion of the pulling/thrusting jack advancing arrangement and between one cylindrical body and another among the fourth and subsequent cylindrical bodies;

connecting members which are arranged to pierce through each of the second cylindrical body and those disposed subsequently thereto; and attachable and detachable fasteners attached to the connecting members respectively in front of the second cylindrical body and between one cylindrical body and another among the third and subsequent cylindrical bodies.

23. An underground structure constructing apparatus adapted for advancing successively adjoining cylindrical bodies, said apparatus comprising in combination:

a pulling jack advancing arrangement disposed between second and third cylindrical bodies and is removably attached to the front of a third cylindrical body;

thrusting jack advancing arrangements which are disposed respectively between one cylindrical body and another among first to fourth cylindrical bodies, said thrusting jack advancing arrangements being removably attached to the rears or fronts of these cylindrical bodies;

traction members which are arranged to pierce through said pulling jack advancing arrangement, the third cylindrical body and every cylindrical body disposed subsequently thereto;

attachable and detachable fixing pieces which are attached to the traction members respectively at the head portion of the pulling jack advancing arrangement and between one cylindrical body and another among the fourth and subsequent cylindrical bodies;

connecting members which are arranged to pierce through the second cylindrical body and all of cylindrical bodies disposed subsequently thereto; and attachable and detachable fasteners which are attached to the connecting members respectively in front of the second cylindrical body and between one cylindrical body and another among the third and subsequent cylindrical bodies.

24. An underground structure constructing apparatus adapted for advancing successively adjoining cylindrical bodies, said apparatus comprising in combination:

a pulling/thrusting jack advancing arrangement disposed between first and second cylindrical bodies and is removably attached to the front of the second cylindrical body;

thrusting jack advancing arrangements which are disposed respectively between one cylindrical body and another among second to fourth cylindrical bodies, said thrusting jack advancing arrangements being removably attached to the rears or fronts of them;

traction members which are arranged to pierce through said pulling/thrusting jack advancing arrangement, the second cylindrical body and all cylindrical bodies disposed subsequently thereto; and attachable and detachable fixing members which are attached to the traction members respectively at the head portion of the pulling/thrusting jack advancing arrangement and between one cylindrical body and another among the fourth and subsequent cylindrical bodies.

25. An underground structure constructing apparatus adapted for advancing successively adjoining cylindrical bodies, said apparatus comprising in combination:

a pulling jack advancing arrangement disposed between first and second cylindrical bodies and is removably attached to the front of the second cylindrical body;

thrusting jack advancing arrangements which are disposed respectively between one cylindrical body and another among first through fourth cylindrical bodies, said thrusting jack advancing arrangements being removably attached either to the rears or to the fronts of said cylindrical bodies;

traction members which are arranged to pierce through said pulling jack advancing arrangement, the second cylindrical body and every cylindrical body disposed subsequently to the second cylindrical body; and attachable and detachable fixing pieces which are attached to the traction members respectively at the head portion of said pulling jack advancing arrangement and between one cylindrical body and another among fourth and subsequent cylindrical bodies.

26. An underground structure constructing apparatus adapted for advancing successively adjoining cylindrical bodies, said apparatus comprising in combination:

a thrusting jack advancing arrangement disposed between cylindrical bodies and is removably attached either to the rear of one cylindrical body or to the front of another;

a pulling jack advancing arrangement removably attached either to the front of a first cylindrical body or to the rear of a hindmost cylindrical body;

connecting members which are arranged to pierce through the pulling jack advancing arrangement and the first cylindrical body and every subsequent one;

attachable and detachable fasteners which are attached to the connecting members respectively at the head portion of the pulling jack advancing arrangement and either in front of the first cylindrical body or in the rear of the hindmost cylindrical body;

a reaction facility installed on one side of a natural ground opposite to another side thereof from which the cylindrical bodies are to be advanced;

another pulling jack advancing arrangement removably attached either to the head portion of the reaction facility or to the rear of the hindmost cylindrical body;

traction members which are arranged to pierce through said reaction facility, a horizontal hole provided in the natural ground, the first cylindrical body and every cylindrical body disposed subsequently thereto and the pulling jack advancing arrangement; and attachable and detachable fixing pieces which are attached to the traction members in front of the reaction facility or in the rear of the hindmost cylindrical body and at the head portion of the pulling jack advancing arrangement.

27. An underground structure constructing apparatus adapted for advancing successively adjoining cylindrical bodies, said apparatus comprising in combination:

thrusting jack advancing arrangements disposed between one cylindrical body and another and are removably attached either to the fronts or rears of the cylindrical bodies;

a pulling jack advancing arrangement removably attached either to the front of a first cylindrical body or to the rear of a hindmost cylindrical body;

connecting members which are arranged to pierce through said pulling jack advancing arrangement, the first cylindrical body and every cylindrical body disposed subsequently thereto;

attachable and detachable fasteners which are attached to the connecting members at the head portion of the pulling jack advancing arrangement and in front of the first cylindrical body;

a reaction facility which is installed on one side of a natural ground opposite to another side thereof from which said cylindrical bodies are to be advanced;

another pulling jack advancing arrangement which is removably attached to the front of the reaction facility;

traction members which are arranged to pierce through the reaction facility, a horizontal hole provided in the natural ground, the first cylindrical body and every cylindrical body subsequent thereto and the pulling jack advancing arrangement; and attachable and detachable pieces which are attached to the traction members at the head portion of the pulling jack advancing arrangement, between one cylindrical body and another and in the rear of the hindmost cylindrical body.

28. An underground structure constructing apparatus according to claim 26 or 27 wherein said traction members are not only provided with a pulling/thrusting jack advancing arrangement at their one end but are also provided with another set of pulling/thrusting jack advancing arrangement which is disposed at the other end thereof.

29. An underground structure constructing apparatus adapted for advancing successively adjoining cylindrical bodies said apparatus comprising in combination:

thrusting jack advancing arrangements which are disposed between one cylindrical body and another and are removably attached respectively either to the fronts or to the rears of cylindrical bodies;

a pulling jack advancing arrangement removably attached to the front of a second cylindrical body;

connecting members which are arranged to pierce through said pulling jack advancing arrangement, the second cylindrical body and every cylindrical body disposed subsequently thereto;

attachable and detachable fasteners connected to said connecting members at the head portion of the pulling jack advancing arrangement and in the rear of the hindmost cylindrical body;

a reaction facility which is installed on one side of a natural ground opposite to another side thereof from which the cylindrical bodies are to be advanced;

another pulling jack advancing arrangement which is removably attached to the front of the reaction facility;

traction members which are arranged to pierce through the pulling jack advancing arrangement, the reaction facility, a horizontal hole which is provided beforehand in the natural ground, the first cylindrical body and all of cylindrical bodies disposed subsequently thereto; and attachable and detachable fixing pieces which are attached to the traction members at the head portion of the pulling jack arrangement, between one cylindrical body and another among the first and subsequent cylindrical bodies and in the rear of the hindmost cylindrical body.

30. An underground structure constructing apparatus as in claim 28 wherein a pulling/thrusting jack advancing arrangement is disposed between said first and second cylindrical bodies.

31. An underground structure constructing apparatus according to claim 29 wherein an additional pulling jack advancing arrangement is disposed between the rear of said hindmost cylindrical body and said fixing pieces and is removably engaged with said traction members.

32. An underground structure constructing apparatus adapted for advancing successively adjoining cylindrical bodies, said apparatus comprising in combination:

traction members arranged to pierce through two groups each consisting of more than two cylindrical bodies on first and second start bases confronting each other across a natural ground where said underground structure is to be constructed and through a horizontal hole which is provided in the natural ground beforehand;

a pulling jack advancing arrangement disposed in the rear of the outermost of the cylindrical body group disposed on the second start base and is removably attached to the traction members;

attachable and detachable fixing pieces which are attached to the traction members between one cylindrical body and another among the group of cylindrical bodies disposed on the first start base and in the rear of the outermost cylindrical body of the same group;

thrusting jack advancing arrangements which are removably attached to cylindrical bodies of the group aligned on the start base having the fixing pieces attached to the traction members;

intermediate members attachably and detachably installed in between one cylindrical body and another on the second start base;

another pulling jack advancing arrangement attachably and detachably attached either to the front of the foremost cylindrical body or to the rear of the hindmost of the cylindrical body group disposed on the first start base, or the group having said thrusting jack advancing arrangements attached to cylindrical bodies;

connecting members which are arranged to pierce through the whole cylindrical body group on the first start base and the pulling jack advancing arrangement; and attachable and detachable fasteners attached to both ends of said connecting members.

33. An underground structure constructing apparatus according to claim 12 wherein another pulling jack advancing arrangement is attachably and detachably attached to the front of the foremost one or to the rear of the hindmost of the cylindrical body group on the same start base; and said attachable and detachable fixing pieces are further attached to said traction members between one cylindrical body and another among the same cylindrical body group disposed on the second start base.

34. An underground structure constructing apparatus according to claim 32, 12 or 33 wherein an additional pulling jack advancing arrangement is detachably attached to one end of the traction members in the rear of the hindmost cylindrical body in the same manner as the other end of the traction member.

35. An underground structure constructing apparatus according to claim 32, 12, 33 or 34 wherein said thrusting jack advancing arrangements, said fixing pieces and said fasteners disposed between one cylindrical body and another are arranged to be placed within cut-away parts which are provided in these cylindrical bodies.

36. A method for constructing an underground structure according to claim 1 wherein facilities for advancing more than three serially adjoining cylindrical bodies are arranged by having a pulling jack advancing arrangement specialized for pulling and a first thrusting jack advancing arrangement specialized for pushing disposed between first and second cylindrical bodies, a second thrusting jack advancing arrangement disposed between second and third cylindrical bodies, traction members arranged to pierce through said pulling jack advancing arrangement, the second cylindrical body and each of said cylindrical bodies subsequent thereto, attachable and detachable fixing pieces attached to said traction members in front of the pulling jack advancing arrangement in the rear of each of the third and subsequent cylindrical bodies, connecting members arranged to pierce through the first, second and third cylindrical bodies and attachable and detachable fasteners attached to said connecting members in front of the first cylindrical body and in the rear of each of the second and third cylindrical bodies; in a first step of operation, which is for advancing said first cylindrical body, said first thrusting jack advancing arrangement disposed between the first and second cylindrical bodies is operated to push the first cylindrical body with a reaction force required for this being obtained from the sum of reaction forces available from the second and thrid cylindrical bodies through the second thrusting jack advancing arrangement disposed between the second and third cylindrical bodies; in a second step of operation, the fixing pieces disposed in the rear of one of the third and subsequent cylindrical bodies to be advanced and in front of the pulling jack advancing arrangements are fixed to the traction members while the fixing pieces disposed in rear of other cylindrical bodies are set free and then, by fixing the fasteners disposed in front of the first cylindrical body and in rear of the second cylindrical body to the connecting members, the pulling jack advancing arrangement is operated to have each of the third and subsequent cylindrical bodies pulled forward one after another with a reaction force required for the pulling operation obtained from the sum of the reaction forces available from the first and second cylindrical bodies; in a third step of operation, the fasteners disposed in front of the first cylindrical body are fixed to the connecting members and then the second thrusting jack advancing arrangement disposed between the second and third cylindrical bodies is operated to have the second cylindrical body pushed forward with a reaction force required for this pushing operation obtained from the sum of the reaction forces of the first and third cylindrical bodies; and the more than three serially adjoining cylindrical bodies are advanced underground by repeating said three steps of operation as required.

37. A method for constructing an underground structure according to claim 1 wherein facilities for advancing more than three serially adjoining cylindrical bodies are arranged by having a pulling jack advancing arrangement disposed in front of a first cylindrical body, a first thrusting jack advancing arrangement disposed between first and second cylindrical bodies, a second thrusting jack advancing arrangement disposed between second and third cylindrical bodies, traction members arranged to pierce through said first cylindrical body, said pulling jack advancing arrangement, the second cylindrical body and each of the cylindrical bodies subsequent thereto, attachable and detachable fixing pieces attached to said traction members in front of said first cylindrical body and in the rear of each of the third and subsequent cylindrical bodies, connecting members arranged to pierce through the first, second and third cylindrical bodies and attachable and detachable fasteners attached to said connecting members in front of the first cylindrical body and in the rear of each of the second and third cylindrical bodies; in a first step of operation which is for advancing said first cylindrical body, said first thrusting jack advancing arrangement is operated to push the first cylindrical body with a reaction force required for this obtained from the sum of reaction forces available from the second and third cylindrical bodies through the second thrusting jack advancing arrangement disposed between the second and third cylindrical bodies; in a second stop of operation, the fixing pieces disposed in the rear of one of the third and subsequent cylindrical bodies to be advanced and in front of the pulling jack advancing arrangement are fixed to the traction members while the fixing pieces disposed in rear of other cylindrical bodies are set free and then, by fixing the fasteners disposed in front of the first cylindrical body and in rear of the second cylindrical body to the connecting members, the pulling jack advancing arrangement is operated to have each of the third and subsequent cylindrical bodies pulled forward one after another with a reaction force required for the pulling operation obtained from the sum of the reaction forces available from the first and second cylindrical bodies available through said first thrusting jack advancing arrangement; in a third step of operation, the fasteners disposed in front of the first cylindrical body and in the rear of the third cylindrical body are fixed to the connecting members and then the second thrusting jack advancing arrangement disposed between the second and third cylindrical bodies is operated to have the second cylindrical body pushed forward with a reaction force required for this pushing operation obtained from the sum of the reaction forces of the first and third cylindrical bodies; and the more than three serially adjoining cylindrical bodies are advanced underground by repeating said three steps of operation as required.

38. A method for constructing an underground structure according to claim 1 wherein facilities for advancing more than three serially adjoining cylindrical bodies are arranged by having a pulling jack advancing arrangement in front of a first cylindrical body, a first thrusting jack advancing arrangement disposed between first and second cylindrical bodies, a second thrusting jack advancing arrangement disposed between second and third cylindrical bodies, traction members arranged to pierce through said first cylindrical body, said pulling jack advancing arrangement, the second cylindrical body and each of cylindrical bodies subsequent thereto, attachable and detachable fixing pieces attached to said traction members in front of said first cylindrical body and in the rear of each of the third and subsequent cylindrical bodies, in a first step of operation which is for advancing said first cylindrical body, said first thrusting jack advancing arrangement is operated to push the first cylindrical body with a reaction force required for this obtained from the sum of reaction forces available from the second and third cylindrical bodies through the second thrusting jack advancing arrangement disposed between the second and third cylindrical bodies; in a second step of operation, the fixing pieces disposed in the rear of one of the third and subsequent cylindrical bodies to be advanced and in front of the pulling jack advancing arrangement are fixed to the traction members while the fixing pieces disposed in rear of other cylindrical bodies are set free and then, by fixing the fasteners disposed in front of the first cylindrical body and in rear of the second cylindrical body to the connecting members, the pulling jack advancing arrangement is operated to have each of the third and subsequent cylindrical bodies pulled forward one after another with a reaction force required for the pulling operation obtained from the sum of the reaction forces available from the first and second cylindrical bodies; in a third step of operation, the fixing pieces are fixed to said traction members in the rear of the third cylindrical body and in front of said pulling jack advancing arrangement and then the second thrusting jack advancing arrangement disposed betwen the second and third cylindrical bodies is operated to have the second cylindrical body pushed forward with a reaction force required for this pushing operation obtained from the sum of the reaction forces of the first and third cylindrical bodies available through said traction members; and the more than three serially adjoining cylindrical bodies are advanced underground by repeating said three steps of operation as required.

39. A method for constructing an underground structure according to claim 1 wherein said cylindrical body advancing facilities are arranged to have more than four serially adjoining cylindrical bodies advanced underground with thrusting jack advancing arrangements disposed between the first and second cylindrical bodies and between the third and fourth cylindrical bodies, a pulling jack advancing arrangement and a thrusting jack advancing arrangement are disposed between the second and third cylindrical bodies, the traction members arranged to pierce through said pulling jack advancing arrangement and each of the third and subsequent cylindrical bodies, said attachable and detachable fixing pieces attached to said traction members in front of the pulling jack advancing arrangement and in the rear of each of the fourth and subsequent cylindrical bodies, said connecting members arranged to pierce through and protrude from the second, third and fourth cylindrical bodies, and said attachable and detachable fasteners attached to the connecting members in front of the second cylindrical body and in the rear of each of the third and fourth cylindrical bodies; in a first step of operation, the thrusting jack advancing arrangement which is disposed between the first and second cylindrical bodies is operated to have the first cylindrical body moved forward with a reaction force required for this obtained from the sum of the reaction forces of the second and third cylindrical bodies or of the second, third and fourth cylindrical bodies available through the various jack advancing arrangements disposed between the second and third cylindrical bodies or the second, third and fourth cylindrical bodies; in a second step of operation, the thrusting jack advancing arrangement which is disposed between the second and third cylindrical bodies is operated to have the second cylindrical body pushed forward with a reaction force required for this pushing operation obtained from the sum of the reaction forces of the third and fourth cylindrical bodies which are available through the thrusting jack advancing arrangement disposed between the third and fourth cylindrical bodies; in a third step of operation, with said fixing pieces fixed to said traction members in the rear of one of the fourth and subsequent cylindrical bodies to be advanced and in front of the pulling jack advancing arrangement, while other fixing pieces disposed in other places are set free, and with the fasteners fixed to said connecting members in front of the second cylindrical body and in the rear of the third cylindrical body, the pulling jack advancing arrangement which is disposed between the second and third cylindrical bodies is operated to have each of the fourth and subsequent cylindrical bodies pulled forward one by one with a reaction force required for the pulling operation obtained from the sum of reaction forces of the second and third cylindrical bodies; in a fourth step of operation, the fasteners disposed in front of the second cylindrical body and in the rear of the third cylindrical body are fixed to the connecting members and the thrusting jack advancing arrangement which is disposed between the second and third cylindrical bodies is operated to push forward the third cylindrical body with a reaction force required for this obtained from the sum of the reaction forces of the second and fourth cylindrical bodies; and said more than four serially adjoining cylindrical bodies are advanced underground by repeating said steps of operation as desired.

40. A method for constructing an underground structure according to claim 1 wherein said cylindrical body advancing facilities are arranged to have more than four serially adjoining cylindrical bodies advanced underground with a pulling jack advancing arrangement and a thrusting jack advancing arrangement being disposed between first and second cylindrical bodies, thrusting jack advancing arrangements disposed respectively between second and third cylindrical bodies and between third and fourth cylindrical bodies, said traction members arranged to pierce through and protrude from said pulling jack advancing arrangement and each of the second and subsequent cylindrical bodies, and said attachable and detachable fixing pieces attached to the traction members in front of the pulling jack advancing arrangement and in the rear of each of the fourth and subsequent cylindrical bodies; then, in a first step of operation, the thursting jack advancing arrangement disposed between the second and third cylindrical bodies is operated to have the first cylindrical body pushed forward with a reaction force required for this pushing operation obtained from the sum of the reaction forces of the second and third cylindrical bodies or the second, third and fourth cylindrical bodies through the thrusting jack advancing arrangement disposed between the second and third cylindrical bodies or through the thrusting jack advancing arrangements disposed between the second and third cylindrical bodies and between the third and fourth cylindrical bodies; in a second step of operation, the thrusting jack advancing arrangement disposed between the second and third cylindrical bodies is operated to push forward the second cylindrical body with a reaction force required for this obtained from the sum of the reaction forces of the third and fourth cylindrical bodies through the thrusting jack advancing arrangement disposed between the third and fourth cylindrical bodies; in a third step of operation, the fixing pieces disposed in the rear of some of the fourth and subsequent cylindrical bodies and in front of the pulling jack advancing arrangement are fixed to the traction members and then the thrusting jack advancing arrangement disposed between the third and fourth cylindrical bodies is operated to push forward the third cylindrical body with a reaction force required for this pushing operation obtained from the sum of the reaction forces of the second cylindrical body and said some of the fourth and subsequent cylindrical bodies; in a fourth step of operation, the fixing pieces disposed in front of the pulling jack advancing arrangement and in the rear of one of the fourth and subsequent cylindrical bodies to be advanced are fixed to the traction members while other fixing pieces are set free and then the pulling jack advancing arrangement is operated to have each of the fourth and subsequent cylindrical bodies pulled forward one by one with a reaction force required for this obtained from the sum of the reaction forces of the second and third cylindrical bodies through the thrusting jack advancing arrangement disposed between the second and third cylindrical bodies; and the more than four serially adjoining cylindrical bodies are advanced underground by repeating said steps of operation as desired.

41. A method according to claim 5 wherein with said horizontal hole arranged to have the start base and the arrival base communicating with each other and with the reaction facility installed on the arrival base, the traction members are arranged to pierce through more than three cylindrical bodies disposed on the start base, the horizontal hole and the reaction facility; then a first pulling jack advancing arrangement which is provided with fixing pieces attachable to and detachable from the traction members is disposed in front of the reaction facility; further fixing pieces are attached to the traction members and are disposed in the rear of each cylindrical body; thrusting jack advancing arrangements are disposed respectively between the first and second cylindrical bodies and between the second and third cylindrical bodies; the connecting members are arranged to pierce through and protrude from each of the second and subsequent cylindrical bodies; then, in combination with the connecting members, a pulling/thrusting jack advancing arrangement which is provided with fasteners attachable to and detachable from the connecting members is disposed in front of the second cylindrical body while other fasteners are disposed in the rear of each of the third and subsequent cylindrical bodies; with the facilities for advancing more than three cylindrical bodies arranged in the above stated manner, in the first step of operation, the pulling/thrusting jack advancing arrangement is operated jointly with the thursting jack advancing arrangement disposed between the first and second cylindrical bodies to have the first cylindrical body pushed forward with a reaction force required for this obtained from the sum of the reaction forces available from the second and third cylindrical bodies through the thrusting jack advancing arrangement disposed between the second and third cylindrical bodies; meanwhile, concurrently with the pushing operation, the fixing pieces disposed in the rear of the first cylindrical body is fixed to the traction members while other fixing pieces disposed in rear of other cylindrical bodies are set free and then the first pulling jack advancing arrangement is also operated to have the first cylindrical body pulled forward through the traction member; in the second stop of operation, while the second cylindrical body is pushed by operating the thrusting jack advancing arrangement disposed between the second and third cylindrical bodies with a required reaction force obtained from the third cylindrical body, the fixing pieces disposed in the rear of the second cylindrical body is fixed to the traction members, with other fixing pieces which are disposed in the rear of each of other cylindrical bodies set free, and the first pulling jack advancing arrangement is also operated to have the second cylindrical body pulled forward; in the third step of operation, the fixing pieces and the fasteners disposed in the rear of each of the third and subsequent cylindrical bodies to be advanced are fixed to the traction members and the connecting members while the fixing pieces and fasteners disposed in rear of other cylindrical bodies are set free and then the first pulling jack advancing arrangement and the pulling/thrusting jack advancing arrangement are jointly operated to move forward each of the third and subsequent cylindrical bodies; and the more than three serially adjoining cylindrical bodies are advanced underground one after another by repeating the first, second and third steps of operation as desired.

42. A method according to claim 5 wherein with said horizontal hole arranged to have the start base and the arrival base communicating with each other and with the reaction facility installed on the arrival base, the traction members are arranged to pierce through more than three cylindrical bodies disposed on the start base, the horizontal hole and the reaction facility; then a first pulling jack advancing arrangement which is provided with fixing pieces attachable to and detachable from the traction members is disposed in front of the reaction facility; further fixing pieces are attached to the traction members and are disposed in the rear of each cylindrical body other than the hindmost cylindrical body; thrusting jack advancing arrangements are disposed respectively between the first and second cylindrical bodies and between the second and third cylindrical bodies; the connecting members are arranged to pierce through and protrude from each of the second and subsequent cylindrical bodies; then, in combination with the connecting members, a second pulling jack advancing arrangement which is provided with fasteners attachable to and detachable from the connecting members is disposed in front of the second cylindrical body while other fasteners are disposed in the rear of each of the third and subsequent cylindrical bodies; a third pulling jack advancing arrangement is provided at the rear of the hindmost cylindrical body for fixing the traction members there; with the facilities for advancing more than three cylindrical bodies arranged in the above stated manner, in the first stage of operation, the thrusting jack advancing arrangement disposed between the first and second cylindrical bodies is operated to have the first cylindrical body pushed forward with a reaction force required for this obtained from the sum of the reaction forces available from the second and third cylindrical bodies through the thrusting jack advancing arrangement disposed between the second and third cylindrical bodies; meanwhile, concurrently with the pushing operation, the fixing pieces disposed in the rear of the first cylindrical body is fixed to the traction members while other fixing pieces disposed in rear of other cylindrical bodies are set free and then the first pulling jack advancing arrangement is also operated to have the first cylindrical body pulled forward through the traction member; in the second step of operation, while the second cylindrical body is pushed by operating the thrusting jack advancing arrangement disposed between the second and third cylindrical bodies with a required reaction force obtained from the third cylindrical body, the fixing pieces disposed in the rear of the second cylindrical body is fixed to the traction members, with other fixing pieces which are disposed in the rear of each of other cylindrical bodies set free, and the first pulling jack advancing arrangement is also operated to have the second cylindrical body pulled forward; in the third step of operation, the fixing pieces and the fasteners disposed in the rear of each of the third and subsequent cylindrical bodies to be advanced are fixed to the traction members and the connecting members while the fixing pieces and fasteners disposed in rear of other cylindrical bodies are set free and then the first and second pulling jack advancing arrangements are jointly operated to move forward each of the third and subsequent cylindrical bodies; with the third pulling jack advancing arrangement disposed in the rear of the hindmost cylindrical body being operated to absorb the elongation and slack of the traction member before advancing each cylindrical body; and the more than three serially adjoining cylindrical bodies are advanced underground one after another by repeating the first, second and third steps of operation as desired.

* * * * *